US010569570B2

(12) United States Patent
Asada et al.

(10) Patent No.: US 10,569,570 B2
(45) Date of Patent: Feb. 25, 2020

(54) CONVEYING DEVICE AND PRINTING APPARATUS

(71) Applicants: Kohki Asada, Tokyo (JP); Masato Ogawa, Kanagawa (JP); Natsuki Sugiyama, Kanagawa (JP)

(72) Inventors: Kohki Asada, Tokyo (JP); Masato Ogawa, Kanagawa (JP); Natsuki Sugiyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/460,591

(22) Filed: Mar. 16, 2017

(65) Prior Publication Data

US 2017/0266988 A1 Sep. 21, 2017

(30) Foreign Application Priority Data

Mar. 18, 2016 (JP) ..... 2016-055143
Jan. 10, 2017 (JP) ..... 2017-001572

(51) Int. Cl.

| | |
|---|---|
| ***B41J 11/00*** | (2006.01) |
| ***B41M 5/00*** | (2006.01) |
| ***F26B 13/10*** | (2006.01) |
| ***F26B 3/28*** | (2006.01) |

(52) U.S. Cl.

CPC ..... *B41J 11/002* (2013.01); *B41J 11/007* (2013.01); *B41J 11/0085* (2013.01); *B41M 5/0011* (2013.01); *F26B 3/283* (2013.01); *F26B 13/101* (2013.01)

(58) Field of Classification Search

CPC ..... B41J 11/002; B41J 11/0085; B41J 11/007; F26B 3/02; B41M 5/0011

See application file for complete search history.

(56) References Cited

U.S. PATENT DOCUMENTS

| | | | | |
|---|---|---|---|---|
| 2003/0156177 | A1* | 8/2003 | Nishikawa | B41J 11/0005 347/102 |
| 2010/0180784 | A1* | 7/2010 | Shiohara | B41J 11/002 101/424.1 |
| 2010/0208021 | A1* | 8/2010 | Hori | B41J 2/0057 347/102 |
| 2016/0273832 | A1 | 9/2016 | Asada et al. | |
| 2016/0370758 | A1 | 12/2016 | Ogawa et al. | |

FOREIGN PATENT DOCUMENTS

| | | |
|---|---|---|
| JP | 7-314826 | 12/1995 |
| JP | 2010-110926 | 5/2010 |
| JP | 2010-137406 | 6/2010 |
| JP | 2010-149417 | 7/2010 |
| JP | 2013-039759 | 2/2013 |

* cited by examiner

*Primary Examiner* — Justin Seo
(74) *Attorney, Agent, or Firm* — Oblon, McClelland, Maier & Neustadt, L.L.P.

(57) ABSTRACT

A conveying device includes a blower, a conveyor, and an upstream blower. The blower blows air to a sheet material. The conveyor includes a sandwiching unit to sandwich the sheet material, and conveys the sheet material to a blowing region of the blower. The upstream blower blows air toward a downstream side in a conveyance direction of the sheet material, from an upstream side of the blowing region in the conveyance direction of the sheet material to the blowing region.

20 Claims, 10 Drawing Sheets

CONVEYING DEVICE AND PRINTING APPARATUS

CROSS-REFERENCE TO RELATED APPLICATIONS

This patent application is based on and claims priority pursuant to 35 U.S.C. § 119(a) to Japanese Patent Application Nos. 2016-055143 filed on Mar. 18, 2016 and 2017-001572 filed on Jan. 10, 2017 in the Japan Patent Office, the entire disclosure of each of which is hereby incorporated by reference herein.

BACKGROUND

Technical Field

Embodiments of the present disclosure relate to a conveying device and a printing apparatus.

Related Art

A printing apparatus, such as an inkjet recording apparatus, may have a conveying device to blow air to an ink adhesion surface of a sheet to dry ink adhered on the sheet.

For example, an inkjet recording apparatus is proposed that includes a drying device to blow air, which is heated by a heater, to an ink adhesion surface of a sheet by a fan to dry ink.

SUMMARY

In an aspect of the present disclosure, there is provided a conveying device that includes a blower, a conveyor, and an upstream blower. The blower blows air to a sheet material. The conveyor includes a sandwiching unit to sandwich the sheet material, and conveys the sheet material to a blowing region of the blower. The upstream blower blows air toward a downstream side in a conveyance direction of the sheet material, from an upstream side of the blowing region in the conveyance direction of the sheet material to the blowing region.

In another aspect of the present disclosure, there is provided a conveying device that includes a blower, a conveyor, and a downstream blower. The blower blows air to a sheet material. The conveyor includes a sandwiching unit to sandwich the sheet material, and conveys the sheet material to eject the sheet material from a blowing region of the blower. The downstream blower blows air toward an upstream side in the conveyance direction of the sheet material, from a downstream side of the blowing region in the conveyance direction of the sheet material to the blowing region.

In still another aspect of the present disclosure, there is provided a printing apparatus that includes a liquid discharger and the conveying device according to any one of the above-described aspects. The liquid discharger discharges liquid to a sheet material. The conveying device blows air to and conveys the sheet material to which the liquid discharged by the liquid discharger adheres.

In still yet another aspect of the present disclosure, there is provided a printing apparatus that includes a liquid discharger, a pre-processing unit, and the conveying device according to any one of the above-described aspects. The liquid discharger discharges liquid. The pre-processing unit is disposed on an upstream side of the liquid discharger in the conveyance direction of the sheet material, to apply a treatment liquid to the sheet material before the liquid discharger discharges the liquid onto the sheet material. The conveying device blows air to and convey the sheet material to which the treatment liquid has been applied by the pre-processing unit.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
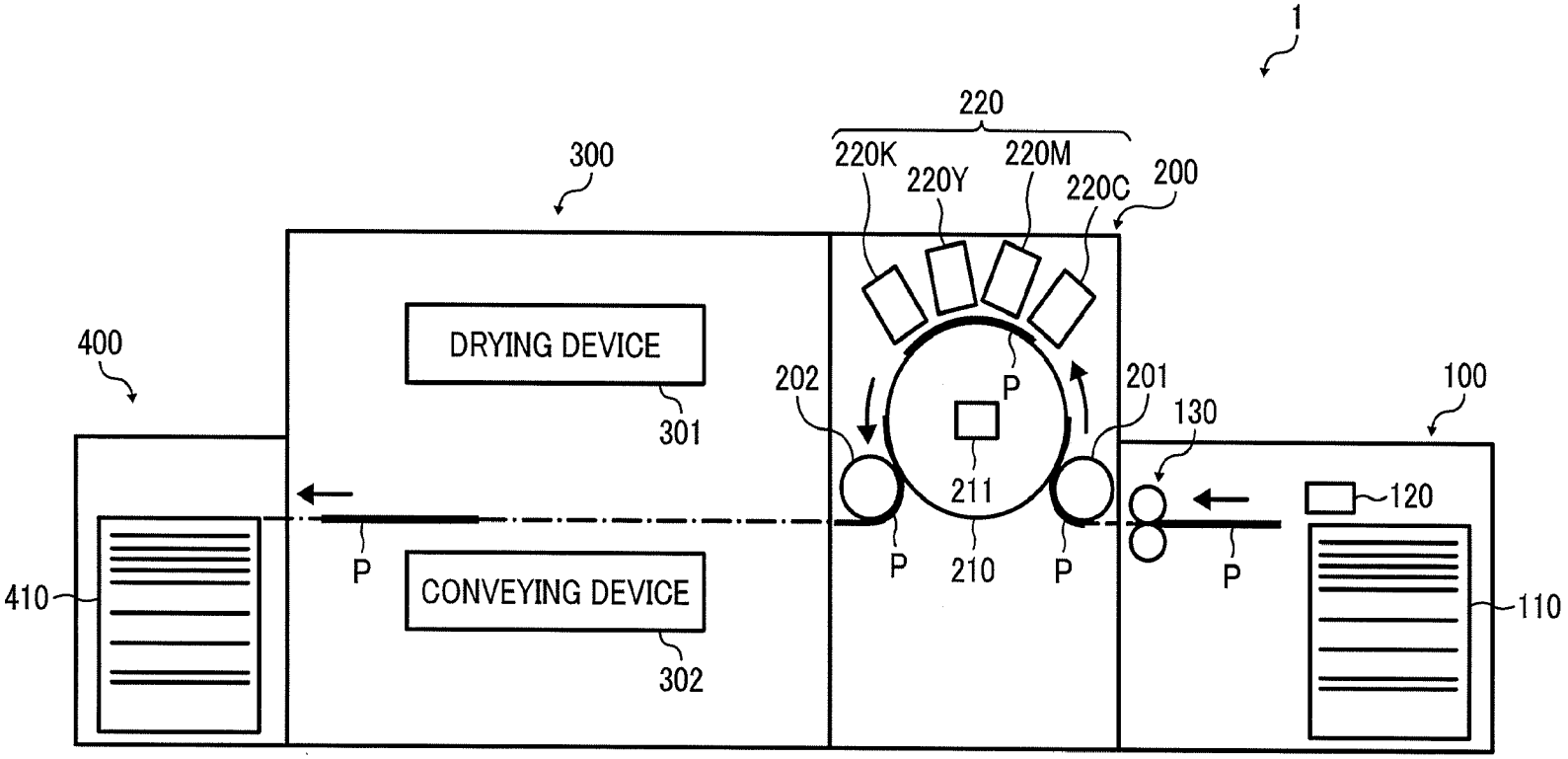
FIG. 1 is a schematic view of a configuration of an inkjet recording apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Hereinafter, embodiments of the present disclosure are described with reference to the drawings.

Hereinafter, embodiments of the present disclosure are described with reference to the drawings.

Overall Description

FIG. 1 is a schematic view of a configuration of an inkjet recording apparatus according to an embodiment of the present disclosure. An inkjet recording apparatus 1 according to the present embodiment includes, for example, a sheet feeding unit 100, an image forming unit 200, a drying unit 300, and a sheet ejection unit 400. In the inkjet recording apparatus 1, an image is formed on the sheet P, which is a recording material as a sheet material fed from the sheet feeding unit 100, with ink that is a liquid for image formation in the image forming unit 200. After the ink adhered to the sheet is dried in the drying unit 300, the sheet is ejected from the sheet ejection unit 400.

Sheet Feeding Unit

The sheet feeding unit 100 includes a sheet feed tray 110 on which a plurality of sheets P is stacked, a sheet feeder 120 to separate and feed the sheets P one by one from the sheet feed tray 110, and paired registration rollers 130 to send the sheet P to the image forming unit 200. As the sheet feeder 120, any sheet feeder, such as a device using rollers or a device using air suction, can be used. After the leading end of the sheet fed from the sheet feed tray 110 by the sheet feeder 120 reaches the paired registration rollers 130, the paired registration rollers 130 are driven at a predetermined timing to feed the sheet to the image forming unit 200. In the present embodiment, the sheet feeding unit 100 is not limited to the above-described configuration and may be any other configuration capable of sending the sheet P to the image forming unit 200.

Image Forming Unit

The image forming unit 200 includes, for example, a transfer cylinder 201 to receive the fed sheet P and transfer the fed sheet P to a sheet bearing drum 210, a sheet bearing drum 210 to bear and convey the sheet P conveyed by the transfer cylinder 201 on an outer circumferential surface of the sheet bearing drum 210, an ink discharge unit 220 to discharge ink toward the sheet P borne on the sheet bearing drum 210, and a transfer cylinder 202 to transfer the sheet P conveyed by the sheet bearing drum 210 to the drying unit 300.

The leading end of the sheet P conveyed from the sheet feeding unit 100 to the image forming unit 200 is gripped by a sheet gripper provided on the surface of the transfer cylinder 201 and conveyed with the movement of the surface of the transfer cylinder 201. The sheet conveyed by the transfer cylinder 201 is delivered to the sheet bearing drum 210 at a position facing the sheet bearing drum 210.

The sheet gripper is also provided on the surface of the sheet bearing drum 210, and the leading end of the sheet is gripped by the sheet gripper. A plurality of suction holes are dispersedly formed on the surface of the sheet bearing drum 210, and a sucked air flow directed toward the inside of the sheet bearing drum 210 is generated in each suction hole by a suction device 211. The leading end of the sheet P delivered from the transfer cylinder 201 to the sheet bearing drum 210 is gripped by the sheet gripper, and the sheet is attracted to the surface of the sheet bearing drum 210 by the suction air flow and is conveyed with the movement of the surface of the sheet bearing drum 210.

The ink discharge unit 220 according to the present embodiment discharges inks of four colors of C (cyan), M (magenta), Y (yellow), and K (black) to form an image, and includes individual liquid discharge heads 220C, 220M, 220Y and 220K for respective inks. The configurations of the liquid discharge heads 220C, 220M, 220Y and 220K are not limited to the above-described configurations and may be any other suitable configurations. For example, a liquid discharge head to discharge special ink, such as white, gold, and silver, may be provided, or a liquid discharge head to discharge a liquid that does not constitute an image, such as a surface coating liquid, may be provided.

The discharge operation of the liquid discharge heads 220C, 220M, 220Y, and 220K of the ink discharge unit 220 is controlled by drive signals corresponding to image information. When the sheet P borne on the sheet bearing drum 210 passes through a region opposed to the ink discharge unit 220, ink of respective colors is discharged from the liquid discharge heads 220C, 220M, 220Y and 220K to form an image in accordance with the image information. In the present embodiment, the image forming unit 200 is not limited to the above-described configuration and may be any other configuration of forming an image by causing liquid to adhere onto the sheet P.

Drying Unit

The drying unit 300 includes, for example, a drying assembly 301 to dry the ink adhered onto the sheet P by the image forming unit 200, and a conveyance assembly 302 to convey the sheet P conveyed from the image forming unit 200. After the sheet P conveyed from the image forming unit 200 is received by the conveyance assembly 302, the sheet is conveyed to pass through the drying assembly 301 and delivered to the sheet ejection unit 400. When passing through the drying assembly 301, the ink on the sheet P is subjected to a drying process. Thus, the liquid content, such as moisture, in the ink evaporates, the ink is fixed on the sheet P, and the curl of the sheet P is reduced.

Sheet Ejection Unit

The sheet ejection unit 400 includes, for example, a sheet ejection tray 410 on which a plurality of sheet P is stacked. The sheet P conveyed from the drying unit 300 is sequentially stacked and held on the sheet ejection tray 410. In the present embodiment, the configuration of the sheet ejection unit 400 is not limited to the above-described configuration and may be any other configuration capable of ejecting the sheet P.

Other Functional Units

The inkjet recording apparatus 1 according to the present embodiment includes the sheet feeding unit 100, the image forming unit 200, the drying unit 300, and the sheet ejection unit 400. In addition, other functional units may be suitably added. For example, a pre-processing unit to perform pre-processing of image formation can be added between the sheet feeding unit 100 and the image forming unit 200, or a post-processing unit to perform post-processing of image formation can be added between the drying unit 300 and the sheet ejection unit 400.

As the pre-processing unit, for example, there is a unit to perform a treatment liquid application process of applying a treatment liquid for reacting with ink to reduce bleeding to the sheet P. However, the content of the pre-processing is not particularly limited to any specific content. In addition, as the post-processing unit, for example, there is a sheet reverse conveyance processing with the image formed by the image forming unit 200 and sending the sheet to the image forming unit 200 again to form images on both sides of the sheet, or a process for binding a plurality of sheets on which the image is formed, and the like. However, the content of the post-processing is also not particularly limited to any specific content.

In the present embodiment, the printing apparatus is described as an example of an inkjet recording apparatus. However, the "printing apparatus" is not limited to an apparatus that includes a liquid discharge head to discharge liquid toward a surface to be dried of the sheet material, and to make visible significant images, such as letters and graphics, with the discharged liquid. For example, the "printing apparatus" may also be an apparatus to form patterns and the like which have no meaning. The material of the sheet material is not limited, and any sheet material, such as paper, thread, fiber, cloth, leather, metal, plastic, glass, wood, and ceramics, to which liquid can temporarily adhere may be used. For example, sheet materials used for film products, cloth products, such as clothing products, building materials, such as a wall sheet or flooring materials, leather products, and the like may be used. The "printing apparatus" can also include units relating to feeding, conveying, and ejection of a sheet to which liquid can adhere, a pre-processing device, a post-processing device and the like. Further, the term "liquid" includes any liquid having a viscosity or a surface tension that can be discharged from the head. The "liquid" is not limited to a particular liquid and may be any liquid having a viscosity or a surface tension to be discharged from a head. However, preferably, the viscosity of the liquid is not greater than 30 mPa·s under ordinary temperature and ordinary pressure or by heating or cooling. More specifically, the "liquid" is, for example, solution, suspension, emulsion or the like that includes a solvent, such as water or an organic solvent, a colorant, such as a dye or a pigment, a functionalizing material, such as a polymerizable compound, a resin, or a surfactant, a biocompatible material, such as DNA, amino acid, protein, or calcium, edible materials, such as natural pigments, and the like. Such liquids can be used, for example, for inkjet inks, surface treatment liquids and the like. Although there is an apparatus in which the liquid discharge head and the sheet material relatively move as the "printing apparatus", embodiments of the present disclosure are not limited to such an apparatus. The "printing apparatus" may be, for example, a serial-type apparatus to move a liquid discharge head relative to a sheet material or a line-type apparatus that does not move a liquid discharge head relative to a sheet material.

Further, the term "liquid discharge head" represents a functional component to discharge and jet liquid from discharge orifices (nozzles). As an energy generating source to discharge liquid, for example, a thermal actuator using an electrothermal transducer element, such as a piezoelectric actuator (lamination-type piezoelectric element and thin-film piezoelectric element) and a heat generation resistor, or a discharge energy generator, such as an electrostatic actuator, including a diaphragm plate and opposed electrodes can be used. However, the energy generating source is not limited to any specific type and may be any other suitable discharge energy generator.

Details of Drying Unit

Figure 2:
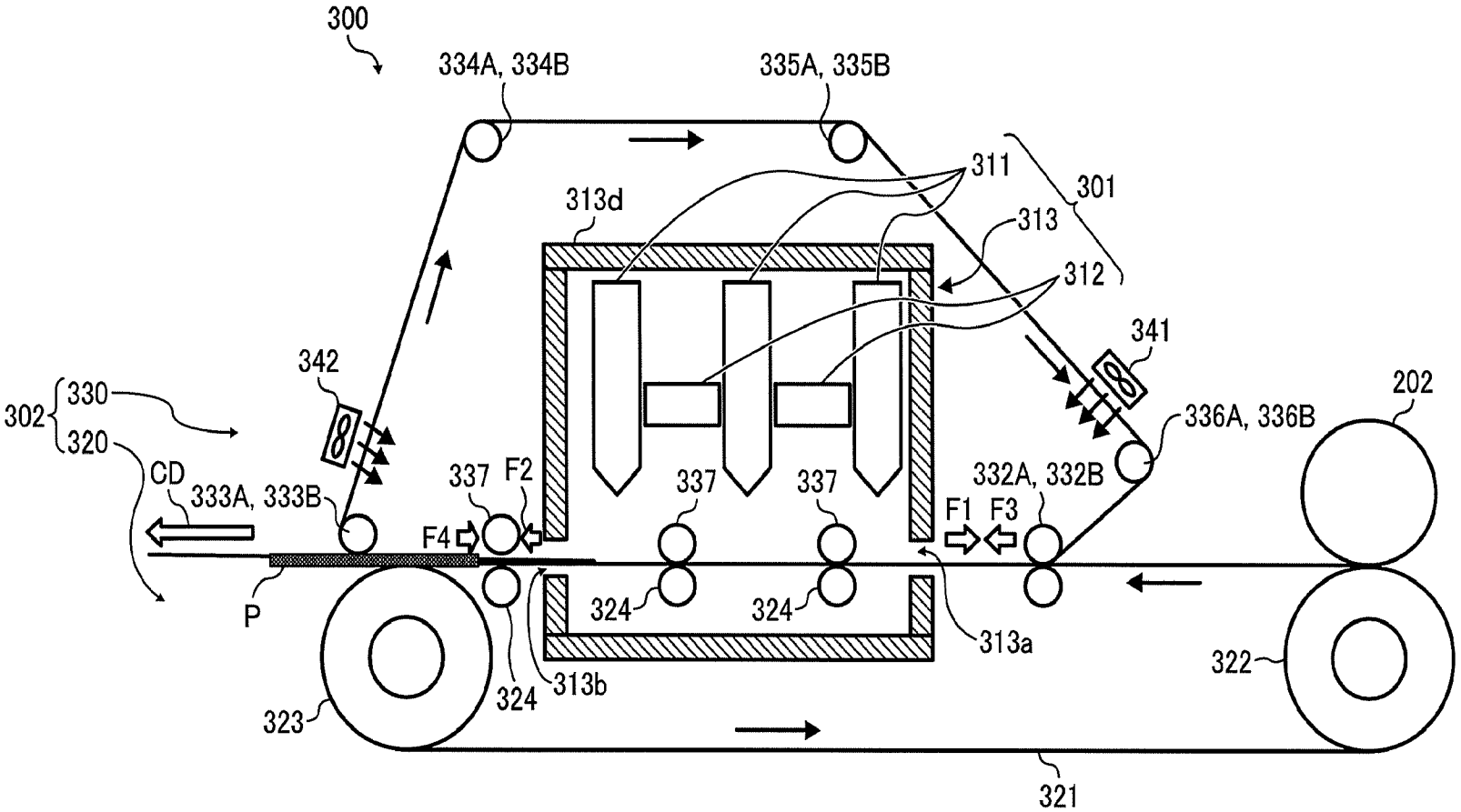
FIG. 2 is a front view of a drying unit of the inkjet recording apparatus.
Figure 3:
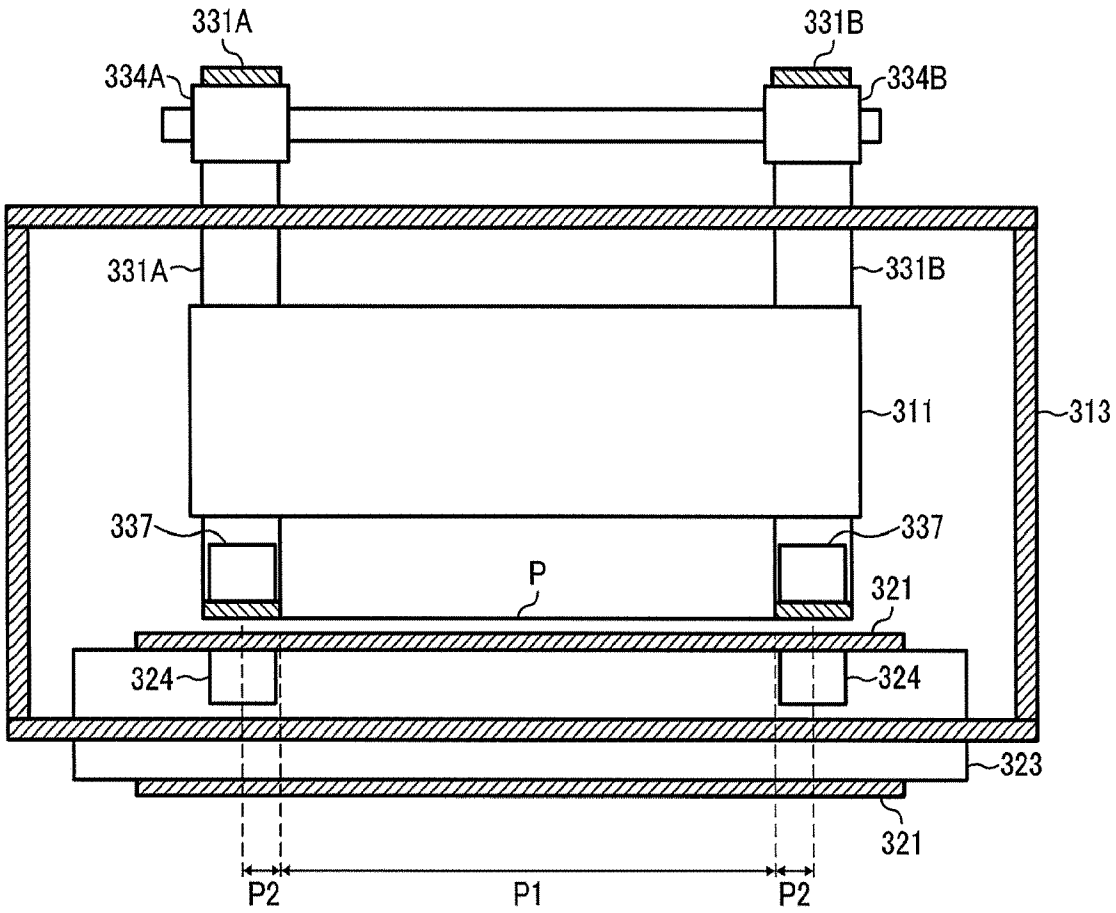
FIG. 3 is a cross-sectional view of the drying unit cut along a plane perpendicular to a sheet conveyance direction.

Next, the drying unit 300 in the present embodiment is further described below. FIG. 2 is a front view of the drying unit 300 in the present embodiment. FIG. 3 is a cross-sectional view of the drying unit 300 in the present embodiment, cut along a plane perpendicular to a direction of conveyance of the sheet (a sheet conveyance direction).

The drying assembly 301 in the drying unit 300 in the present embodiment includes, for example, a blowing fan 311 to blow air toward the sheet P conveyed by the conveyance assembly 302, a radiation heater 312 as a heater to radiate radiant heat (for example, infrared rays), and a drying chamber 313 formed by surrounding the periphery of the blowing region blown by the blowing fan 311 with a wall member 313*d*. At least a part of the wall member 313*d* of the drying chamber 313 is formed of a heat insulating material so that the internal temperature of the drying chamber 313 is not easily lowered. In the drying assembly 301, the ink on the image surface of the sheet P is dried by the radiant heat of the radiation heater 312 and the air blown by the blowing fan 311 with respect to the image surface of the sheet P conveyed to the internal space of the drying chamber 313.

In the drying assembly 301 of the present embodiment, a plurality of (three in the present embodiment) blowing fans 311 is disposed side by side in the sheet conveyance direction indicated by arrow CD in FIG. 2, but the number and arrangement of the blowing fans 311 are arbitrary. In the drying assembly 301 of the present embodiment, a plurality (two in the embodiment) of the radiation heaters 312 is disposed side by side in the sheet conveyance direction CD, but the number and arrangement of the radiation heaters 312 are also arbitrary.

The conveyance assembly 302 of the present embodiment includes, for example, a belt conveyor 320 and a sheet pressing assembly 330. The belt conveyor 320 bears the sheet P on the surface of the endless conveyance belt 321 stretched between the two support rollers 322 and 323, and conveys the sheet P in accordance with the movement of the surface of the conveyance belt 321. The length of the conveyance belt 321 in a direction (width direction) perpendicular to the sheet conveyance direction CD is set to be equal to or greater than the length of the conveyed sheet P in the width direction. The sheet pressing assembly 330 presses the sheet P borne on the surface of the conveyance belt 321 toward the surface of the conveyance belt 321, and mainly functions to enhance sheet conveyance properties provided by the belt conveyor 320.

The conveyance belt 321 mainly travels in the direction of the arrow in the FIG. 1 by movement of at least one of the two support rollers 322 and 323, and the surface moves. Metal, rubber, or the like can be used as the material of the conveyance belt 321, and the material is not particularly limited. However, in the present embodiment, it is preferable to use a heat-resistant material (heat-resistant rubber, metal, or the like) in consideration of being exposed to a high temperature when passing through the inside of the drying chamber 313.

An upstream portion of the conveyance belt 321 in the sheet conveyance direction CD (a belt portion wound around the first support roller 322) is disposed to face the transfer cylinder 202 of the image forming unit 200. The sheet P conveyed by the transfer cylinder 202 is delivered to the conveyance belt 321 in such a manner that a back side of the image surface faces a front side of the conveyance belt 321, and the sheet P is borne on the surface of the conveyance belt 321. The sheet P borne on the surface of the conveyance belt 321 is conveyed to the side of the second support roller 323 with the movement of the surface of the conveyance belt 321.

The sheet P is mainly held on the surface of the conveyance belt 321 by the action of electrostatic force or frictional force, and the conveyance belt 321 in the present embodiment does not have a mechanism, such as a sheet gripper, but the sheet P may be held on the surface of the conveyance belt 321 by the sheet gripper or the like.

A belt portion (a belt portion that moves from the first support roller 322 to the second support roller 323) that bears the sheet on the conveyance belt 321 is disposed to pass through the inside of the drying chamber 313 of the drying assembly 301. Accordingly, the sheet P borne on the surface of the conveyance belt 321 passes through the inside of the drying chamber 313 of the drying assembly 301 with the movement of the surface of the conveyance belt 321. After that, the sheet P is separated from the surface of the conveyance belt 321, and is delivered to the sheet ejection unit 400 via a guide plate, a conveyance roller, or the like.

The sheet pressing assembly 330 according to the present embodiment includes two end pressing belts 331A and 331B that support both end portions P2 in the width direction of the sheet P borne on the surface of the conveyance belt 321. One end pressing belt 331A is an endless belt stretched over the five support rollers 332A, 333A, 334A, 335A and 336A, and abuts against one end portion of the sheet P in the width direction of the sheet P to press the sheet toward the surface of the conveyance belt 321. Similarly, the other end pressing belt 331B is also an endless belt stretched over five support rollers 332B, 333B, 334B, 335B and 336B and abuts against the other end portion of the sheet P in the width direction of the sheet P to press the sheet toward the surface of the conveyance belt 321. Each of the support rollers supporting the two end pressing belts 331A and 331B is disposed on a common rotation axis between the two end pressing belts 331A and 331B.

As the material of the two end pressing belts 331A and 331B, metal, rubber or the like can be used, and its material is not particularly limited. However, it is preferable to use a heat-resistant material (heat resistant rubber, metal, or the like) in consideration of being exposed to a high temperature when passing through the inside of the drying chamber 313.

The two end pressing belts 331A and 331B are belt portions that move from the first support rollers 332A and 332B toward the second support rollers 333A and 333B. The two end pressing belts 331A and 331B press each end portion P2 of the sheet P in the width direction toward the surface of the conveyance belt 321. In the present embodiment, three pressing rollers 337 are provided on each of the inner circumferential face sides of the belt portions of the two end pressing belts 331A and 331B, respectively. A back-up roller 324 is provided on the inner circumferential face side of the conveyance belt 321 of the belt conveyor 320 at positions facing the pressing rollers 337 and the first support rollers 332A, 332B. As a result, both end portions P2 in the sheet width direction of the sheet P borne on the surface of the conveyance belt 321 are continuously pressed by the two end pressing belts 331A and 331B at a sufficient pressure, at least in a section from the first support rollers 332A and 332B to the pressing rollers 337 located on the most downstream side in the sheet conveyance direction CD. Thus, a state of being sandwiched between the two end pressing belts 331A and 331B and the surface of the conveyance belt 321 is maintained.

The two end pressing belts 331A and 331B in the present embodiment are configured to be movable in the sheet width direction, together with the five support rollers, the pressing rollers 337 and the back-up roller 324 stretching and supporting the two end pressing belts 331A and 331B, respectively. Such a configuration allows both end portions P2 of the sheet in the width direction to be pressed against the surface of the conveyance belt 321 by the two end pressing belts 331A and 331B, even in the sheets of different sizes in the width direction. The length in the sheet width direction of each end portion P2 in the width direction of the sheet pressed by the two end pressing belts 331A and 331B is set to about several mm (for example, 5 mm or more and 10 mm or less), and only a margin portion (non-image forming region) is preferably pressed by the two end pressing belts 331A and 331B.

Reduction of Curling of Leading End of Sheet

In the present embodiment, when the sheet P borne on the surface of the conveyance belt 321 passes through the inside of the drying chamber 313 of the drying assembly 301, the sheet P receives air supply of the blowing fan 311 from the substantially normal direction of the image surface (blown surface) of the sheet P. At this time, the conveyance belt 321 of the present embodiment bears a sheet portion located within the blowing region blown by the blowing fan 311, specifically, a central area P1 of the sheet P in the width direction of the sheet P excluding the both end portion P2 in the sheet width direction pressed by the two end pressing belts 331A and 331B, from the back side of the image surface (blown surface) of the sheet P. Therefore, even when the air from the blowing fan 311 hits the image surface (blown surface) of the sheet P, a situation in which the sheet P is pushed and bent by the air is reduced. Therefore, a conveyance failure (a conveyance failure occurring when the central area P1 of the sheet P in the width direction of the sheet P is pushed by the wind, the sheet bends, and the deviation of the sheet occurs at a sandwiching position of the sheet) is reduced which may occur in a configuration in which the sheet is conveyed while sandwiching only the both end portions P2 of the sheet P in the width direction. In addition, in the present embodiment, since the air from the blowing fan 311 pushes the central area P1 of the sheet P in the width direction of the sheet P, the adhesion between the sheet P and the conveyance belt 321 is enhanced. Thus, more stable sheet conveyance can be attained.

As long as the portion of the conveyance belt 321 that bears the sheet portion (the central area P1 of the sheet P in the width direction of the sheet P) located in the blowing region blown by the blowing fan 311 has a structure that entirely supports the back side of the sheet portion, the surface of the portion of the conveyance belt 321 does not need not to be flat.

In the present embodiment, before the sheet P enters the blowing region (within the drying chamber 313 in the present embodiment) blown by the blowing fan 311, air from the blowing fan 311 hits the surface of the conveyance belt 321 existing in the blowing region.

Figure 4:
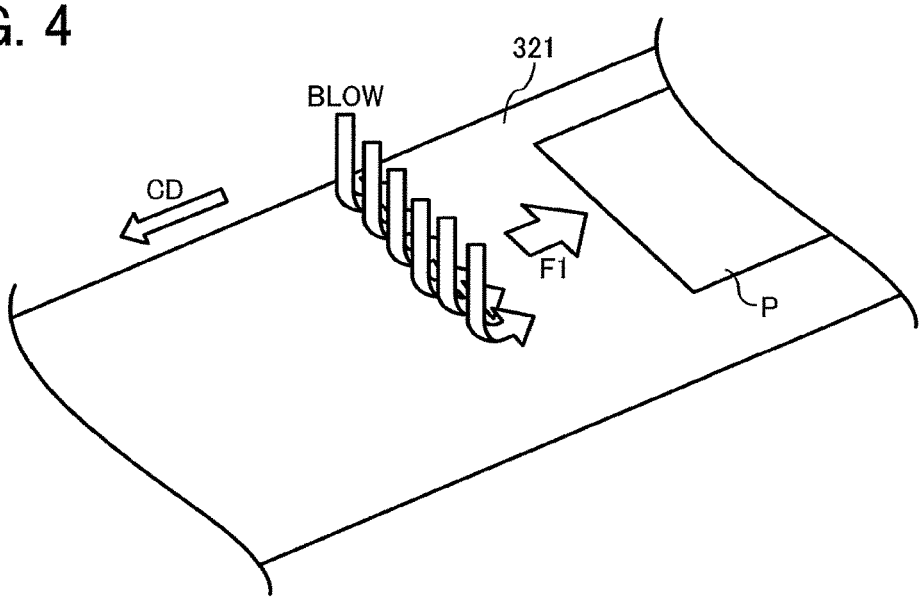
FIG. 4 is an illustration of a state in which air from a blowing fan hits a surface of a conveyance belt in a blowing region, and an air flow is generated toward a leading end of a sheet entering the blowing region from an upstream side in the sheet conveyance direction.

In this way, the air hitting the surface of the conveyance belt 321 advances along the surface of the conveyance belt 321, and as illustrated in FIG. 4, an air flow F1 directed toward the leading end of the sheet P entering the blowing region from the upstream side in the sheet conveyance direction CD is generated. Such an air flow F1 rolls up the leading end of the sheet before the sheet P enters the blowing region. Thus, the leading end of the sheet is caught by a surrounding member, such as the wall member 313*d* of the drying chamber 313, or the sheet P is peeled off from the conveyance belt 321, which may lead to a conveyance failure.

Therefore, in the present embodiment, the two end pressing belts 331A and 331B are configured to press the leading end of the sheet P entering the blowing region toward the surface of the conveyance belt 321. As a result, even if the air flow F1 is generated as described above, the leading end of the sheet P is pressed against the surface of the conveyance belt 321 by the two end pressing belts 331A and 331B until the leading end enters the blowing region, and curling is reduced. As a result, a conveyance failure, such as the leading end of the sheet being caught on the surrounding member such as the wall member 313*d* of the drying chamber 313 is reduced, and stable sheet conveyance can be obtained.

Further, in the present embodiment, only the both end portions in the width direction at the leading end of the sheet P entering the blowing region are pressed by the two end pressing belts 331A and 331B, and the central area in the width direction is not pressed.

Such a configuration allows the leading end of the sheet P entering the blowing region to be pressed against the surface of the conveyance belt 321, without disturbing the ink in the non-dried state before entering the blowing region. In addition, when the leading end of the sheet is curled by the air flow F1, the sheet is normally curled from the one end side of the sheet leading end in the width direction. Therefore, if the both end portions in the width direction at the leading end of the sheet P are pressed, the curling of the vehicle is stably reduced.

However, a configuration of pressing central area in the width direction of the sheet leading end is not excluded. When adopting such a configuration, it is preferable to press central area in the width direction of the sheet leading end, by a configuration that does not disturb the ink in a non-dried state, such as a spur wheel.

Further, in the present embodiment, the blowing region is surrounded by the wall member 313*d* of the drying chamber 313. The drying chamber 313 of the present embodiment has a sheet inlet 313*a* to receive the sheet P from the upstream side in the sheet conveyance direction CD into the inside of the drying chamber 313, and a sheet outlet 313*b* to eject the sheet P from the inside of the drying chamber 313 to the downstream side in the sheet conveyance direction CD. The drying chamber 313 has no openings in other portions. Therefore, the air flow F1 generated by blowing of the blowing fan 311 is easily blown out strongly from the inside of the drying chamber 313 toward the outside through the sheet inlet 313*a*. Therefore, the strong air flow F1 blown out from the sheet inlet 313*a* hits the leading end of the sheet P before entering from the sheet inlet 313*a* of the drying chamber 313, and the leading end of the sheet easily rolls up.

Therefore, in the present embodiment, from the upstream side to the downstream side in the sheet conveyance direction CD of the sheet inlet 313*a* of the drying chamber 313, the sheet P is conveyed continuously toward the surface of the conveyance belt 321 by the two end pressing belts 331A and 331B. Thus, the leading end of the sheet P is continuously pressed against the surface of the conveyance belt 321 until the leading end of the sheet P passes through the sheet inlet 313*a*, and even if a strong air flow F1 is blown out from the sheet inlet 313*a*, the curling of the sheet leading end is stably reduced.

In the present embodiment, on the upstream side in the sheet conveyance direction CD from the pressing start position (specifically, the position at which the two end pressing belts 331A and 331B come into contact with the surface of the conveyance belt 321 by the first support rollers 332A and 332B, hereinafter, referred to as a "sandwiching start position") at which pressing of the sheet P is started, the sheet P borne on the surface of the conveyance belt 321 is not pressed by the two end pressing belts 331A and 331B. Therefore, there is a risk that the leading end of the sheet entering the sandwiching start position might be curled up by the air flow F1. In particular, when the sheet P is curled at the time of conveyance at the transfer cylinder 202 of the image forming unit 200 or the sheet P is wrinkled due to the liquid content of the ink, the leading end of the sheet P might float on the upstream side in the sheet conveyance direction CD from the sandwiching start position. In such a case, the air flow F1 directed toward the sandwiching start position enters the back side of the sheet leading end, and the leading end of the sheet is likely to roll up.

If the leading end of the sheet entering the sandwiching start position is curled up, the leading end of the sheet cannot properly enter between the conveyance belt 321 and the end pressing belts 331A and 331B which may result in a conveyance failure, or the leading end of the sheet may be folded at the time of entering between the conveyance belt 321 and the end pressing belts 331A and 331B, and there is a risk of a damage to the sheet P. Therefore, the sandwiching start position is preferably set at a position where the momentum of the air flow F1 blown out of the sheet inlet 313*a* becomes sufficiently small.

However, there is a disadvantage that causes an increase in the size of the drying unit 300 in the sheet conveyance direction CD as the sandwiching start position moves away from the sheet inlet 313*a* of the drying chamber 313 toward the upstream side in the sheet conveyance direction CD. Such a disadvantage is more remarkable since the momentum of the air flow F1 increases as the air volume of the blowing fan 311 increases. In a case where the blowing region is located inside the drying chamber 313 as in the present embodiment, as described above, the air flow F1 generated by the blowing of the blowing fan 311 vigorously blows out of the sheet inlet 313*a*. Accordingly, if the sandwiching start position is set at the position where the momentum of the air flow F1 is sufficiently small, there would arise the disadvantage of increase in the size of the drying unit 300 in the sheet conveyance direction CD.

Hence, on the upstream side in the sheet conveyance direction CD from the blowing region in the drying chamber 313, that is, on the upstream side in the sheet conveyance direction CD from the sheet inlet 313*a* of the drying chamber 313 in the present embodiment, a blowing fan (hereinafter, referred to as "upstream blowing fan") 341 is disposed separately from the blowing fan 311 in the drying chamber 313. The blowing direction of the upstream blowing fan 341 faces the downstream side in the sheet conveyance direction CD, and the blowing toward the downstream side in the sheet conveyance direction CD is performed toward the sheet inlet 313*a* (toward the blowing region) by the upstream blowing fan 341.

Figure 5:
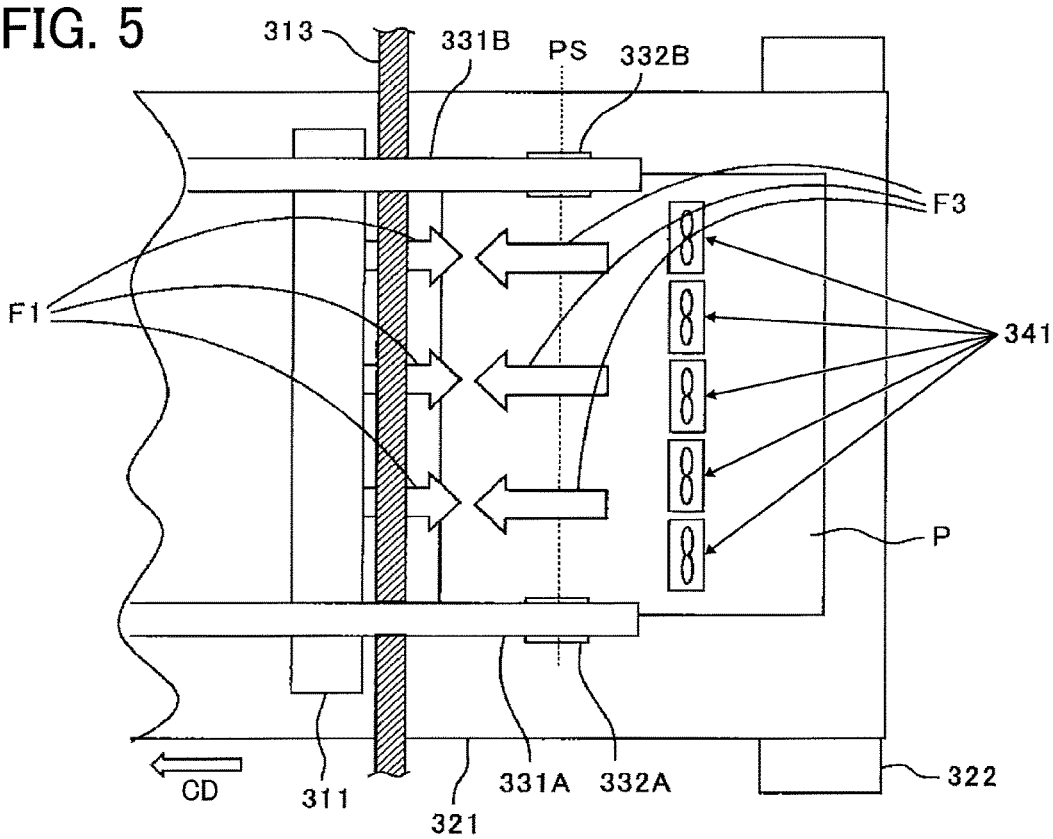
FIG. 5 is a top view of a state in which an air flow is generated by blowing of an upstream blowing fan in the drying unit.

FIG. 5 is a top view of the air flow generated by the blowing of the upstream blowing fan 341. The momentum of the air flow F1 flowing to the sandwiching start position by the blowing fan 311 in the drying chamber 313 is canceled by an air flow F3 generated by the blowing of the upstream blowing fan 341. Accordingly, the momentum of the air flow F1 directed toward the upstream side in the sheet conveyance direction CD at the sandwiching start position decreases. That is, the momentum of the air flow F1 which curls up the leading end of the sheet P before entering the sandwiching start position decreases. Such a configuration allows the leading end of the sheet P to be properly sandwiched between the conveyance belt 321 and the end pressing belts 331A and 331B. As a result, it is possible to reduce a disadvantage in which the leading end of the sheet P does not properly enter between the conveyance belt 321 and the end pressing belts 331A and 331B to cause a conveyance failure, or a disadvantage in which the leading end of the sheet is folded at the time of entering between the conveyance belt 321 and the end pressing belts 331A and 331B to damage the sheet P.

In the present embodiment, after the air from the upstream blowing fan 341 hits the surface portion of the conveyance belt 321 located on the upstream side of the sheet inlet 313*a* in the sheet conveyance direction CD, the air flows to the downstream side in the sheet conveyance direction CD along the surface of the conveyance belt 321 and is directed toward the sheet inlet 313*a*. Accordingly, the air blown by the upstream blowing fan 341 generates a force which presses the leading end of the sheet after passing through the sandwiching start position at which the pressing of the sheet P is started against the surface of the conveyance belt 321. As a result, at the leading end of the sheet before entering the sheet inlet 313*a*, both end portions P2 in the width direction are pressed by the two end pressing belts 331A and 331B, and the central portion P1 in the width direction is pressed by the two end pressing belts 331A and 331B by blowing of the upstream blowing fan 341.

At the leading end of the sheet before entering the sheet inlet 313*a*, both end portions P2 in the width direction are pressed by the two end pressing belts 331A and 331B. However, since the central portion P1 in the width direction is not pressed, flapping may occur in the central portion P1 in the width direction of the sheet leading end by the air flow F1. In the present embodiment, the air from the upstream blowing fan 341 can press the central portion P1 in the width direction which is not pressed by the two end pressing belts 331A and 331B, thus reducing flapping.

Although it is preferable that the upstream blowing fan 341 blows an air toward the sheet conveyance section from the sandwiching start position to the blowing region as in the present embodiment, it is preferable to blow air so as to generate the air flow F3 toward the downstream side in the sheet conveyance direction CD toward the blowing region. Further, in the present embodiment, as illustrated in FIG. 5, a plurality (five in the present embodiment) of upstream blowing fans 341 may be disposed side by side in the width direction, but the number and arrangement of the upstream blowing fan 341 are arbitrary.

Therefore, the two end pressing belts 331A and 331B in the present embodiment are disposed so that the belt portion, which is stretched from the upstream support rollers 336A and 336B disposed on the upstream side in the sheet conveyance direction CD from the sandwiching start position at which the pressing of the sheet P is started to first support rollers 332A and 332B disposed at the sandwiching start position, approaches the surface of the conveyance belt 321 from the upstream side toward the downstream side in the sheet conveyance direction CD. Accordingly, even when the leading end of the sheet P curls up on the upstream side in the sheet conveyance direction CD from the sandwiching start position, the leading end of the sheet comes into contact with the belt portions of the two end pressing belts 331A and 331B. After that, the leading end of the sheet is guided toward the sandwiching start position with the movement of the surface of the end pressing belts 331A and 331B. As a result, even if the leading end of the sheet P curls up on the upstream side in the sheet conveyance direction CD from the sandwiching start position, the leading end of the sheet P can smoothly enter between the end pressing belts 331A and 331B and the conveyance belt 321, and a conveyance failure or a damage to sheet can be reduced.

Reduction of Curling of Sheet in Drying Chamber

After the leading end of the sheet enters the blowing region in the drying chamber 313, the leading end of the sheet is pressed against the surface of the conveyance belt 321 by the air from the blowing fan 311. Accordingly, in the blowing region, since the curling of the leading end of the sheet is unlikely to occur, it is not always required to press the leading end of the sheet P by the end pressing belts 331A and 331B. However, in the present embodiment, since the blowing region is inside the drying chamber 313, if the leading end of the sheet P rises in the blowing region, there is a risk that the sheet P remains within the drying chamber 313 due to the conveyance failure. In addition, in some cases, the trailing end of the sheet P rolls up in the blowing region, and in that case, there is also a risk that the sheet P may remain in the drying chamber 313 due to the conveyance failure.

Since the interior of the drying chamber 313 is a space with a small opening, a work of taking out the sheet P with conveyance failure from the interior is not easy. Therefore, as far as possible, it is desirable to avoid an occurrence of conveyance failure inside the drying chamber 313. In addition, when heat generator, such as a radiation heater 312, is disposed inside the drying chamber 313 as in the present embodiment, it is also important to avoid a situation in which the sheet P comes into contact with the heat generator.

Therefore, in the present embodiment, there is a configuration in which the leading end and the trailing end of the sheet P are also continuously pressed by the two end pressing belts 331A and 331B inside the drying chamber 313 (inside the blowing region). Such a configuration stably reduces the curling of the leading end and the trailing end of the sheet P inside the drying chamber 313. Accordingly, the occurrence of a situation in which the sheet P remains in the drying chamber 313 or the sheet P comes into contact with the heat generator can be reduced.

Further, by the configuration in which the sheet P is pressed against the conveyance belt 321 by the two end pressing belts 331A and 331B inside the drying chamber 313 (inside the blowing region), as illustrated in FIG. 5, even if a fold indicated by reference numeral P3 or a wrinkle indicated by reference numeral P4 occurs in the sheet P, the sheet P can be stably conveyed by the conveyance belt 321. Thus, a conveyance failure, which may occur due to the fold P3 being caught on the internal parts of the drying chamber 313 or the adhesion between the sheet P and the conveyance belt 321 being lowered by the wrinkle P4, is unlikely to occur inside the drying chamber 313. Even if the fold P3 or wrinkle P4 occurs on the sheet P, such a configuration can reduce the occurrence of the situation where the sheet P remains inside the drying chamber 313.

Reduction of Curling at Trailing End of Sheet

Figure 6:
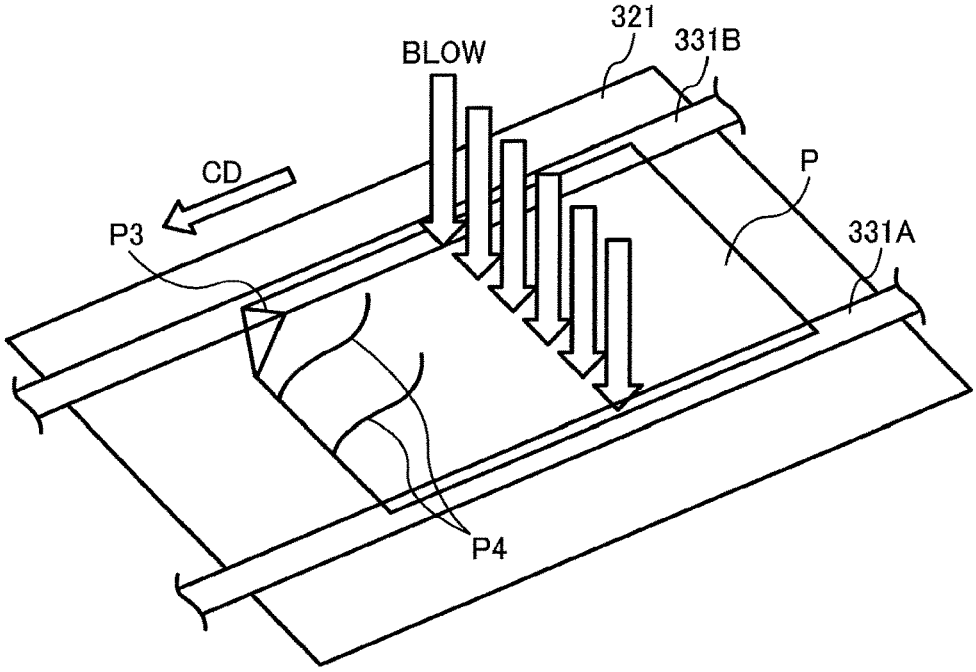
FIG. 6 is an illustration of a state in which a sheet is conveyed in a drying chamber even if the sheet is folded or wrinkled.

Further, in the present embodiment, even after the sheet P passes through the blowing region that is blown by the blowing fan 311, air from the blowing fan 311 hits the surface of the conveyance belt 321 existing in the blowing region. Air hitting the surface of the conveyance belt 321 travels along the surface of the conveyance belt 321 in this way. As illustrated in FIG. 6, an air flow F2 flowing toward the trailing end of the sheet P that has passed through the blowing region toward the downstream side in the sheet conveyance direction CD. Such an air flow F2 may cause a conveyance failure by curling the trailing end of the sheet P that has passed through the blowing region and peeling off the sheet P from the conveyance belt 321.

Therefore, in the present embodiment, the two end pressing belts 331A and 331B are configured to press the trailing end of the sheet P that has passed through the blowing region toward the surface of the conveyance belt 321. As a result, even if the air flow F2 is generated as described above, the trailing end of the sheet P is pressed against the surface of the conveyance belt 321 by the two end pressing belts 331A and 331B until the trailing end passes a predetermined pressing portion after passing through the blowing region, and the curling is reduced. Therefore, a conveyance failure, such as peeling of the sheet P from the conveyance belt 321 due to curling of the trailing end of the sheet, is reduced, and a stable sheet conveyance property can be attained.

In the present embodiment, like the above-described blowing-off of the air flow F1 from the sheet inlet 313*a*, the air flow F2 generated by the blowing of the blowing fan 311 is easy to strongly blow out from the inside of the drying chamber 313 to the outside through the sheet outlet 313*b*. As a result, the strong air flow F2 blown out from the sheet outlet 313*b* hits the trailing end of the sheet P that has passed through the sheet outlet 313*b* of the drying chamber 313, and the trailing end of the sheet is liable to be curled.

In the present embodiment, from the upstream side to the downstream side of the sheet conveyance direction CD of the sheet outlet 313*b* of the drying chamber 313, the sheet P is continuously pressed against the surface of the conveyance belt 321 by the two end pressing belts 331A and 331B. Therefore, even after the trailing end of the sheet P passes through the sheet outlet 313*b* before passing, the trailing end of the sheet P is continuously pressed against the surface of the conveyance belt 321. Thus, even if the strong air flow F2 is blown out from the sheet outlet 313*b*, the curling of the trailing end of the sheet is stably reduced.

In the present embodiment, on the downstream side in the sheet conveyance direction CD from the pressing end position (specifically, the position at which the two end pressing belts 331A and 331B are separated from the surface of the conveyance belt 321, hereinafter referred to as "sandwiching end position") at which the pressing of the sheet P is ended, the sheet P borne on the surface of the conveyance belt 321 is not pressed by the two end pressing belts 331A and 331B. Therefore, there is a risk that flapping may occur in the trailing end of the sheet passing through the sandwiching end position due to the air flow F2. Therefore, it is desirable to appropriately set the sandwiching end position at a position where the momentum of the air flow F2 blown out of the sheet outlet 313*b* becomes sufficiently small.

However, as the sandwiching end position moves away from the sheet outlet 313*b* of the drying chamber 313 toward the downstream side in the sheet conveyance direction CD, there is a disadvantage that causes an increase in size of the drying unit 300 in the sheet conveyance direction CD. Such a disadvantage is more remarkable, since the momentum of the air flow F2 increases as the air volume of the blowing fan 311 increases. In a case where the blowing region is located inside the drying chamber 313 as in the present embodiment, as described above, the air flow F2 generated by the blowing of the blowing fan 311 vigorously blows out of the sheet outlet 313*b*. Accordingly, when the sandwiching end position is set at the position where the momentum of the air flow F2 is sufficiently small, the disadvantage of increase in the size of the drying unit 300 in the sheet conveyance direction CD is inevitable.

Hence, on the downstream side in the sheet conveyance direction CD from the blowing region in the drying chamber 313, that is, on the downstream side in the sheet conveyance direction CD from the sheet outlet 313*b* of the drying chamber 313 in the present embodiment, a blowing fan (hereinafter, referred to as "downstream blowing fan") 342 is disposed separately from the blowing fan 311 in the drying chamber 313. The blowing direction of the downstream blowing fan 342 faces the upstream side in the sheet conveyance direction CD, and the blowing toward the upstream side in the sheet conveyance direction CD is performed toward the sheet outlet 313*b* (toward the blowing region) by the downstream blowing fan 342.

Since the air flow F4 generated by the blowing of the downstream blowing fan 342 cancels the momentum of the air flow F2 flowing to the sandwiching end position by the blowing fan 311 in the drying chamber 313, the momentum of the air flow F2 toward the downstream side in the sheet conveyance direction CD at the sandwiching end position decreases. That is, the momentum of the air flow F2, which causes the trailing end of the sheet P after passing through the sandwiching end position to flap, becomes small. As a result, flapping of the trailing end of the sheet P after passing through the sandwiching end position can be reduced, and a stable sheet conveyance property can be obtained.

Further, in the present embodiment, after the air from the downstream blowing fan 342 hits the image surface of the sheet P passing through the downstream side of the sheet outlet 313*b* in the sheet conveyance direction CD, the air flows to the upstream side in the sheet conveyance direction CD along the image surface toward the sheet outlet 313*b*. Accordingly, the air blown by the downstream blowing fan 342 generates a force for pressing the trailing end of the sheet after passing through the sheet outlet 313*b* against the surface of the conveyance belt 321. As a result, at the trailing end of the sheet after passing through the sheet outlet 313*b*, both end portions P2 in the width direction are pressed by the two end pressing belts 331A and 331B, and the central portion P1 in the width direction is pressed by air blown by the downstream blowing fan 342.

Both end portions P2 in the width direction of the trailing end of the sheet after passing through the sheet outlet 313*b* are pressed by the two end pressing belts 331A and 331B. However, since the central portion P1 in the width direction is not pressed, flapping may occur in the central portion P1 in the width direction of the trailing end of the sheet due to the air flow F2. In the present embodiment, since the central portion P1 in the width direction which is not pressed by the two end pressing belts 331A and 331B can be pressed by the air from the downstream blowing fan 342, flapping at a portion pressed by the two end pressing belts 331A and 331B can also be suppressed.

It is preferable that the downstream blowing fan 342 blows the air toward the sheet conveyance section from the blowing region to the sandwiching end position. However, it is preferable to perform blowing so that the air flow F4 toward the upstream side in the sheet conveyance direction CD is generated toward the blowing region. In the present embodiment, like the upstream blowing fan 341, a plurality of (five in the present embodiment) downstream blowing fans 342 are disposed side by side in the sheet width direction. However, the number and arrangement of the downstream blowing fans 342 may be arbitrarily set.

The drying unit 300 of the present embodiment does not necessarily need to include a heat generator, such as the radiation heater 312, since the drying unit 300 includes the blower, such as the blowing fan 311, blows air toward the sheet P. However, the drying unit 300 preferably includes the heat generator to dry ink in a shorter time. The heat generator is not limited to a unit that generates radiant heat like the radiation heater 312. A unit that generates heat transmitted from the member coming into contact with the sheet P, such as the conveyance belt 321 or the end pressing belts 331A and 331B, to the sheet P may be used. Further, heat generator for raising the temperature inside the drying chamber 313 may be used. In this case, hot air can be made to hit on the sheet P by the blowing fan 311.

Figure 7:
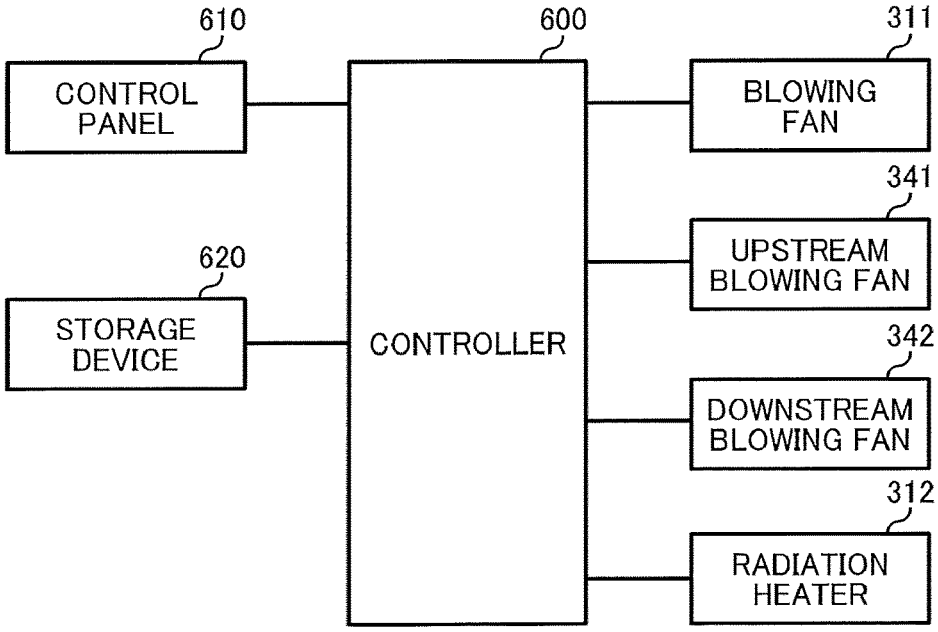
FIG. 7 is a block diagram of a configuration of control of the blowing fan, a radiation heater, the upstream blowing fan, and the downstream blowing fan.
Figure 8:
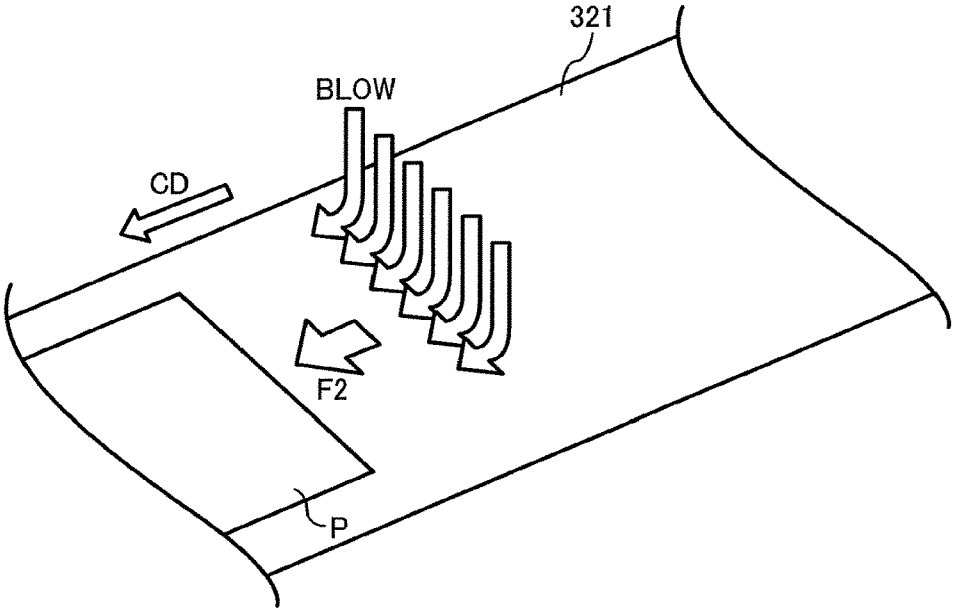
FIG. 8 is an illustration of a state in which air from the blowing fan hits the surface of the conveyance belt in the blowing region and an air flow is generated toward a trailing end of a sheet passing through the blowing region.

The blowing fan 311 of the present embodiment incorporates a heater. Settings of various parameters, such as the temperature of the heater, the air speed and air volume of the blowing fan 311, and the distance between the blowing fan 311 and the surface of the conveyance belt 321, can be changed by a controller 600 illustrated in FIG. 7. The setting values of various parameters are changed in accordance with, for example, the type of the sheet P, the ink adhesion amount to the sheet P, the sheet conveyance speed of the conveyance belt 321, and the like. For example, the controller 600 may change setting values of various parameters on the basis of input information that is input by an operator through a control panel 610 provided in the inkjet recording apparatus 1, or may change the setting values of various parameters, using data or program stored in advance in a storage device 620. The various parameters can be manually adjusted by an operator.

Likewise, settings of parameters, such as the air speed and air volume, of the upstream blowing fan 341 and the downstream blowing fan 342 can be changed by the controller 600.

Setting of parameters, such as the output wavelength of the radiation heater 312, are also changeable in accordance with the type of the sheet P, the ink adhesion amount to the sheet P, the sheet conveyance speed of the conveyance belt 321, and the like. For changing the setting of parameters, as in the case of the blowing fan 311, for example, setting values of various parameters may be changed based on input information that is input by an operator through the control panel 610 provided in the inkjet recording apparatus, or the setting values of various parameters may be changed, using data or programs stored in the storage device 620 illustrated in FIG. 7. Manual adjustment can also be performed by the operator.

Although the two end pressing belts 331A and 331B in the present embodiment are configured to rotate with the surface of the conveyance belt 321, the two end pressing belts 331A and 331B may be configured to be driven by the driving force of one of the support rollers. Even in this case, it is preferable to drive the two end pressing belts 331A and 331B so that the surfaces of the two end pressing belts 331A and 331B move at the constant speed as the surface of the conveyance belt 321. If there is a speed difference between the surfaces of the two end pressing belts 331A and 331B and the surface of the conveyance belt 321, the sheet P pinched between them slips. Thus, there is a risk of meandering of the sheet P or scratches of the sheet P.

The two end pressing belts 331A and 331B in the present embodiment are not entirely disposed in the drying chamber 313, but as illustrated in FIGS. 2 and 3, a part of the two end pressing belts 331A and 331B is disposed to pass the outside of the drying chamber 313. Since the interior of the drying chamber 313 in the present embodiment becomes high temperature, when the entire end pressing belts 331A and 331B are disposed in the drying chamber 313, the end pressing belts 331A and 331B are exposed to high temperatures for a long period of time. Thus, the highest achieving temperatures of the end pressing belts 331A and 331B increase, and the service life is shortened. According to the present embodiment, the end pressing belts 331A and 331B can be cooled down when passing the outside the drying chamber 313 and the highest achieving temperature of the end pressing belts 331A and 331B can be lowered to lengthen the service life. At this time, a cooler for cooling the end pressing belts 331A and 331B passing the outside of the drying chamber 313 may be provided. There is no particular limitation on this cooler, but the air cooling system of the cooling fan is inexpensive and suitable.

Further, in the present embodiment, the portion in which the two end pressing belts 331A and 331B come into contact with the conveyance belt 321 is clamped between the pressing roller 337 and the back-up roller 324. However, the clamping force can be set to be changed. The clamping force changes depending on, for example, the type of the sheet P, the thickness of the sheet P and the like. The setting change of the clamping force, for example, can be achieved by a configuration that changes the biasing force of the pressing roller 337 to change the clamping force, by changing by changing the length of the biasing spring urging the pressing roller 337 toward the back-up roller 324.

Three pressing rollers 337 are disposed side by side in the sheet conveyance direction CD in the present embodiment, but the number or the arrangement interval of the pressing rollers 337 are appropriately set. However, even when conveying the minimum size sheet (the sheet with the shortest length in the conveyance direction CD, it is preferable to set the number and arrangement interval such that the sheet is always pressed by one or more pressing rollers 337. In the present embodiment, the two end pressing belts 331A and 331B are configured to follow the conveyance belt 321. However, since the frictional force between the two end pressing belts 331A and 331B and the conveyance belt 321 increases by pressing applied by the pressing roller 337, the pressing roller 337 also contributes to stable follow-up of the end pressing belts 331A and 331B. The material of the pressing roller 337 is not particularly limited. However, considering that the pressing roller 337 is disposed inside the drying chamber 313 and is exposed to a high temperature for a long period of time, it is preferable to use a heat-resistant material, particularly, a metal.

Figure 9:
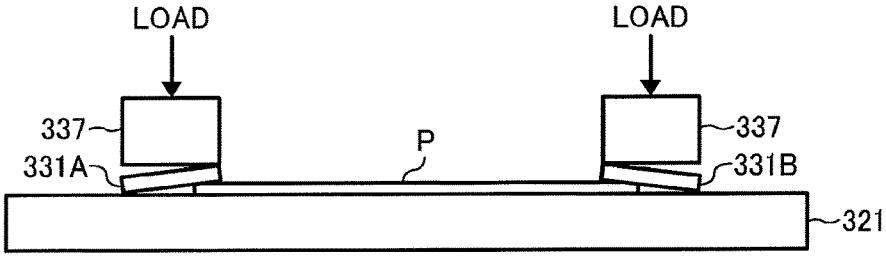
FIG. 9 is an illustration of a sheet pressing location in a case where a presser in the drying unit is formed by a flat belt.
Figure 10:
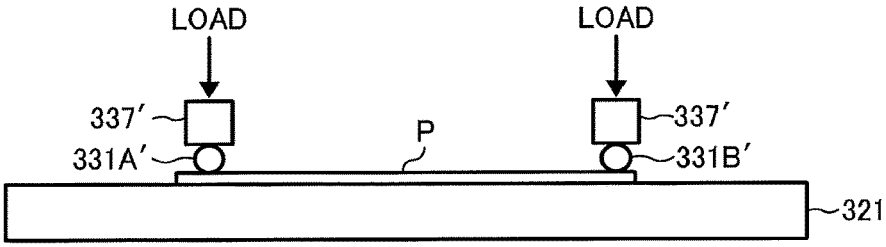
FIG. 10 is an illustration of a sheet pressing location in a case where the presser in the drying unit is formed by a member having a circular cross-section.

As illustrated in FIG. 9, a flat belt is adopted as the two end pressing belts 331A and 331B in the embodiment. However, as illustrated in FIG. 10, other surface movable members, such as end pressing members 331A' and 331B', made of a round belt or a metal wire having a circular cross-section may be used. Further, in the case of reducing the curling of the leading end and the trailing end of the sheet P, a member capable of pressing the sheet P against the surface of the conveyance belt 321 may be used with, for example, pressing rollers 337'. Thus, the presser may be used to press the sheet P against the surface of the conveyance belt 321 by a plate spring or the like rather than the surface movable member.

However, in the case of a flat belt as in the present embodiment, as illustrated in FIG. 9, the end of the sheet P in the width direction can be fully covered, thus effectively preventing intrusion of the air flows F1 and F2 from the end of the sheet P in the width direction. Further, in the case of a flat belt as in the present embodiment, as illustrated in FIG. 9, even in the locations at which the two end pressing belts 331A and 331B press the sheet P, the outside of the end pressing belts 331A and 331B in the width direction can contact the surface of the conveyance belt 321. In this case, since the contact area between the two end pressing belts 331A and 331B and the conveyance belt 321 can be secured, this is advantageous for a case where the two end pressing belts 331A and 331B are rotated with the surface of the conveyance belt 321 as in the present embodiment driven.

Meanwhile, as illustrated in FIG. 10, in the case of the end pressing members 331A' and 331B' made of a round belt or a metal wire, the contact area with the sheet P can be reduced and damage to the sheet P can be reduced. Moreover, it is easier to make the structure cheaper than in the case of a flat belt.

The conveyance belt 321 in the present embodiment has a structure that generally supports the back side of a sheet portion (the central portion P1 in the width direction of the sheet P) located inside the blowing region blown by the blowing fan 311. However, embodiments of the present disclosure are not limited to the structure. For example, only the both end portions P2 in the sheet width direction pressed by the two end pressing belts 331A and 331B may be supported from the back side of the sheet P. Even in such a case, before the sheet P enters the sandwiching start position, the air from the blowing fan 311 hits the image surface (blown surface) of the sheet conveyed in advance, and the air flow F1 can be generated. Accordingly, there is a risk that the air flow F1 generated by hitting the preceding sheet curls up the leading end of the succeeding sheet before entering the sandwiching start position, causing a conveyance failure of the succeeding sheet or a damage to the succeeding sheet. Therefore, the configuration in which the upstream blowing fan 341 is provided as in the present embodiment is also effective in a configuration in which only the both end portion P2 in the sheet width direction pressed by the two end pressing belts 331A and 331B are supported from the back side of the sheet P.

Similarly, after the preceding sheet has passed the sandwiching end position, the air from the blowing fan 311 hits the image surface (blown surface) of the succeeding sheet and the air flow F2 can be generated. Accordingly, there is a risk that the air flow F2 generated after hitting the succeeding sheet curls up the trailing end of the preceding sheet after passing through the sandwiching end position, causing a conveyance failure of the preceding sheet. Therefore, the configuration in which the downstream blowing fan 342 is provided as in the present embodiment is also effective in the configuration in which only the both end portions P2 in the sheet width direction pressed by the two end pressing belts 331A and 331B are supported from the back side of the sheet P.

Variation 1

Next, a variation of the drying unit 300 in the present embodiment (this variation will be referred to as "Variation 1") will be described. Although the basic configuration of the Variation 1 is the same as that of the above-described embodiment, except that the belt conveyor 320 adopts a conveyance belt 325 including a suction belt instead of the conveyance belt 321. Hereinafter, differences from the above-described embodiment will be mainly described.

Figure 11:
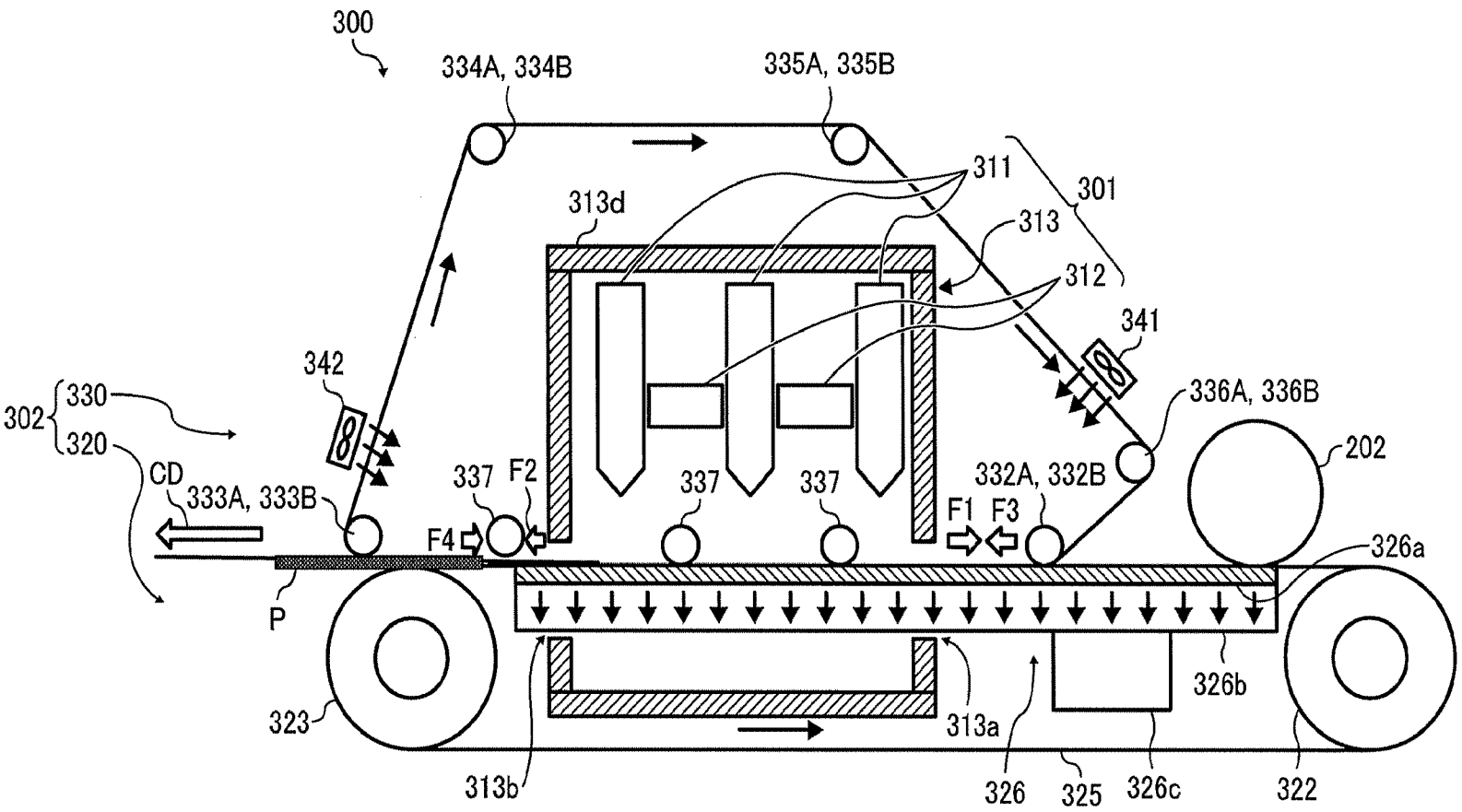
FIG. 11 is a front view of the drying unit in Variation 1.
Figure 12:
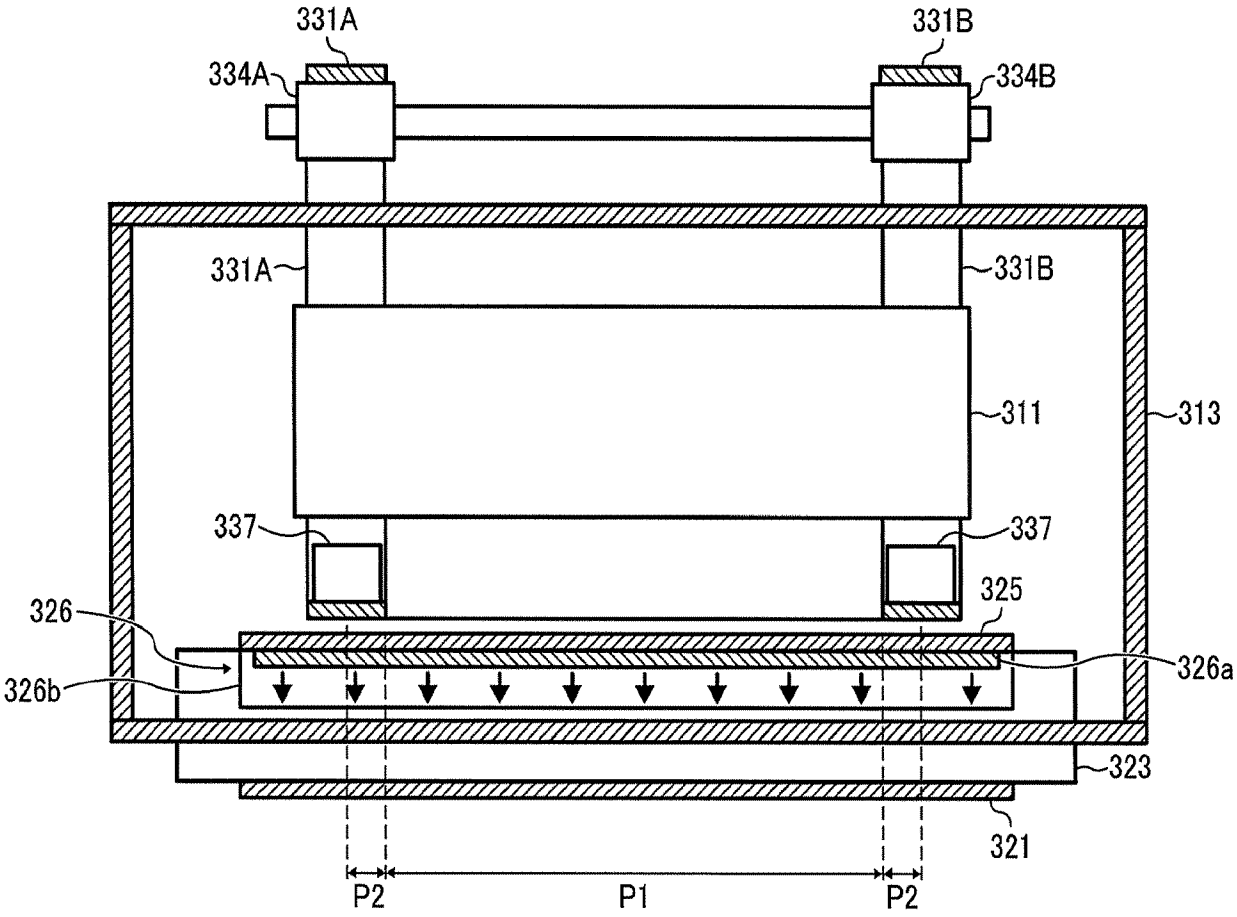
FIG. 12 is a cross-sectional view of the drying unit cut along a plane perpendicular to the sheet conveyance direction.

FIG. 11 is a front view of the drying unit 300 in Variation 1. FIG. 12 is a cross-sectional view when the drying unit 300 in Variation 1 is cut along a plane perpendicular to the sheet conveyance direction CD. The belt conveyor 320 in Variation 1 also bears the sheet P on a surface of an endless conveyance belt 325 stretched between the two support rollers 322 and 323, and conveys the sheet P along with the movement of the surface of the conveyance belt 325. The conveyance belt 325 of Variation 1 is a suction belt in which a plurality of minute through holes (suction holes) are opened in a dispersed manner on the surface thereof. A suction system 326 is provided on an inner circumferential face side of a belt portion (a belt portion in which the first support roller 322 moves toward the second support roller 323).

The suction system 326 includes, for example, a suction chamber 326*b*, and a suction device 326*c* to suck air in the suction chamber 326*b*. An upper wall portion of the suction chamber 326*b* is formed of a porous material 326*a*. When the inside of the suction chamber 326*b* enters a negative pressure state by the suction of the suction device 326*c*, a suction air flow toward the inside of the suction chamber is generated on the upper surface of the suction chamber 326*b*, via a plurality of pores present in the porous material 326*a*.

When at least one of the two support rollers 322 and 323 is driven, the conveyance belt 325 travels in the direction of the arrow in the drawing and the surface moves. At this time, due to the sucked air flow generated on the upper surface of the suction chamber 326*b*, the inner circumferential face of the conveyance belt 325 is attracted to the upper surface of the suction chamber 326*b*, and the conveyance belt 325 moves, while sliding on the upper surface of the suction chamber 326*b*.

In addition, due to the suction air flow generated on the upper surface of the suction chamber 326*b*, a suction air flow also occurs in the suction hole formed in the conveyance belt 325. As a result, the sheet P conveyed by the transfer cylinder 202 and delivered onto the surface of the conveyance belt 325 is sucked onto the surface of the conveyance belt 325 by the sucked air flow. Along with the movement of the surface of the conveyance belt 321, the sheet passes through the inside of the drying chamber 313 of the drying assembly 301. After that, the sheet is separated from the surface of the conveyance belt 321 and delivered to the sheet ejection unit 400.

According to Variation 1, since the sheet P is attracted onto the surface of the conveyance belt 325 by the air flow sucked by the suction system 326, the sheet P is stably held on the surface of the conveyance belt 325 as compared with the above-described embodiment. Therefore, in Variation 1, the curling of the sheet P can more stably reduced than in the above-described embodiment.

It is not always required to form the upper wall portion of the suction chamber 326*b* with the porous material 326*a*. However, by forming the upper wall portion with the porous material 326*a*, even in the case of suction with a suction device 326*c* from one location in the suction chamber 326*b*, a constant suction air flow can be generated over the entire upper surface of the suction chamber 326*b*.

Variation 2

Next, another variation of the drying unit 300 in the present embodiment (hereinafter, this variation will be referred to as "Variation 2") will be described. The basic configuration of Variation 2 is the same as that of the above-described embodiment, except including an air flow guide 343 which rectifies the air from the upstream blowing fan 341. Hereinafter, differences from the above-described embodiment will be mainly described.

Figure 13:
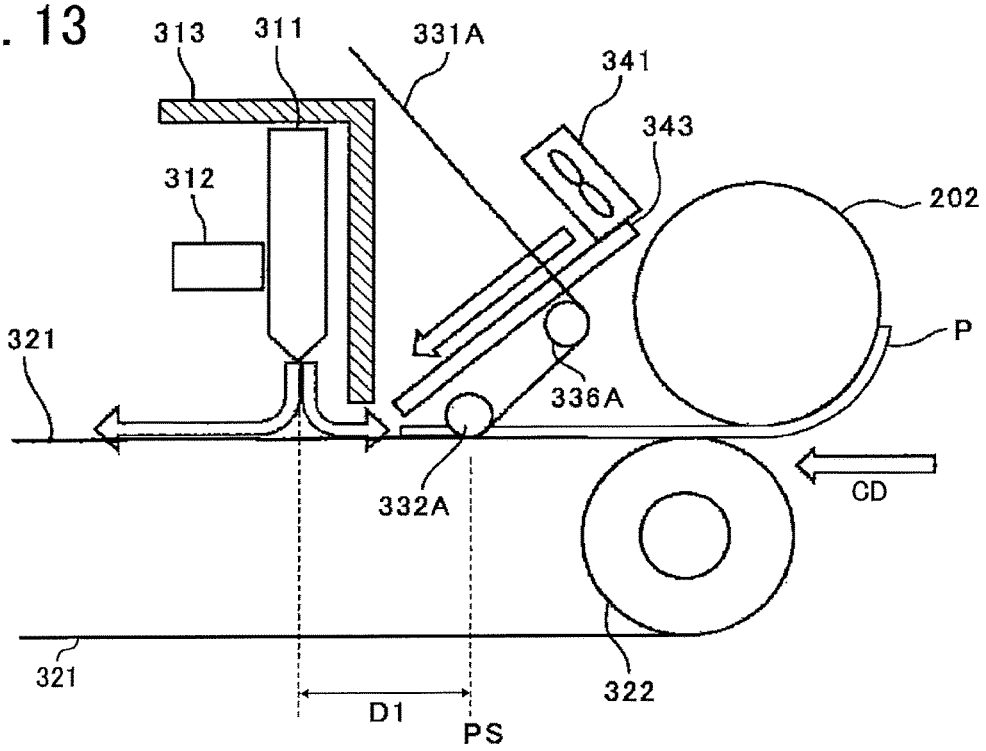
FIG. 13 is a partial front view of an example of the drying unit on the upstream side in the sheet conveyance direction in Variation 2.

FIG. 13 is a front view of a portion of the drying unit 300 on the upstream side in the sheet conveyance direction CD in Variation 2. In Variation 2, the air flow guide 343 that rectifies the flow of the air until the air from the upstream blowing fan 341 reaches the vicinity of the sheet conveyance path (the surface of the conveyance belt 321) is attached to the upstream blowing fan 341. The air flow guide 343 is provided so that the rectifying surface extends along the blowing direction of the upstream blowing fan 341, and reduces the air from the upstream blowing fan 341 from being diffused outside from the blowing direction. As a result, efficient blowing is performed in a target location (for example, a sheet conveying section from the sandwiching start position to the blowing region) D1.

The air flow guide 343 according to Variation 2 isolates the blowing route from the sheet conveyance path, until the air from the upstream blowing fan 341 reaches the vicinity of the target location D1 on the sheet conveyance path. As a result, the air from the upstream blowing fan 341 is prevented from flowing toward the leading end of the sheet before being conveyed to the target location D1, and it is possible to prevent the leading end of the sheet before entering the sandwiching start position PS from curling up or flapping due to the influence of the air from the upstream blowing fan 341.

Figure 14:
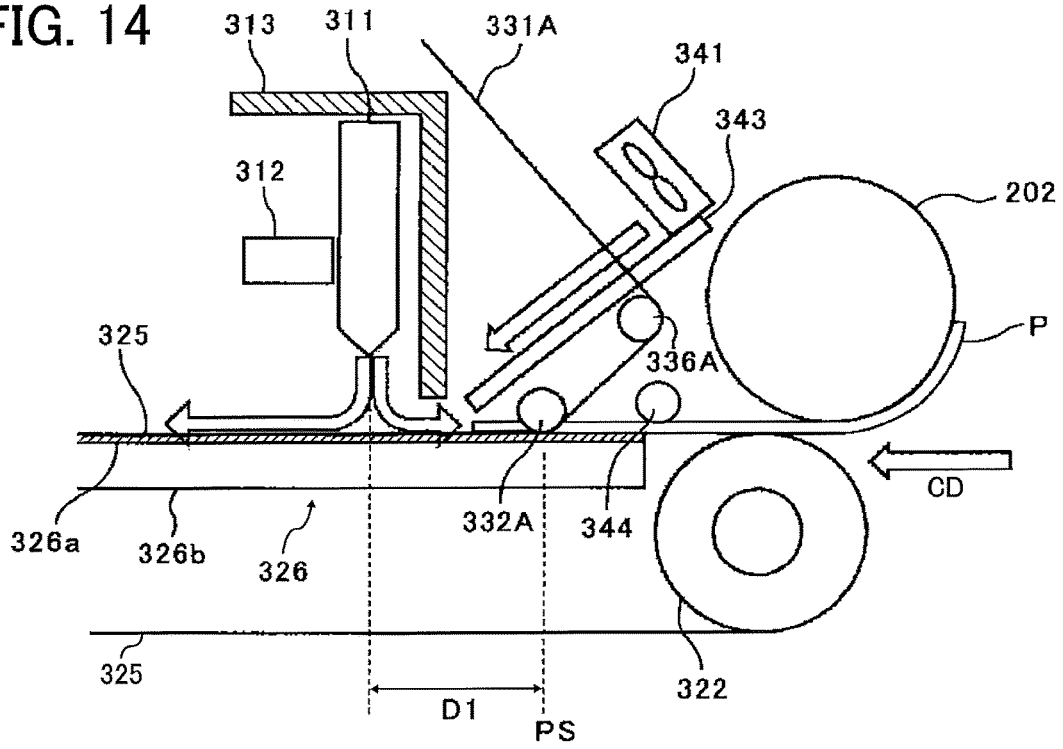
FIG. 14 is a partial front view of another example of the drying unit on the upstream side in the sheet conveyance direction in Variation 2.

When there is a risk that the leading end of the sheet before entering the sandwiching start position is curled up or flapped by the influence of the air from the upstream blowing fan 341, as illustrated in FIG. 14, it is effective to use the suction system 326 of the aforementioned first variation together. Further, as illustrated in FIG. 14, it is also possible to dispose the pressing roller 344 so as to press the leading end of the sheet before entering the sandwiching start position.

Variation 3

Next, still another variation of the drying unit 300 in the present embodiment (hereinafter, this variation will be referred to as "Variation 3") will be described. The basic configuration of Variation 3 is similar to that of the above-described embodiment, except including an air flow guide 345 which rectifies the air from the downstream blowing fan 342. Hereinafter, differences from the above-described embodiment will be mainly described.

Figure 15:
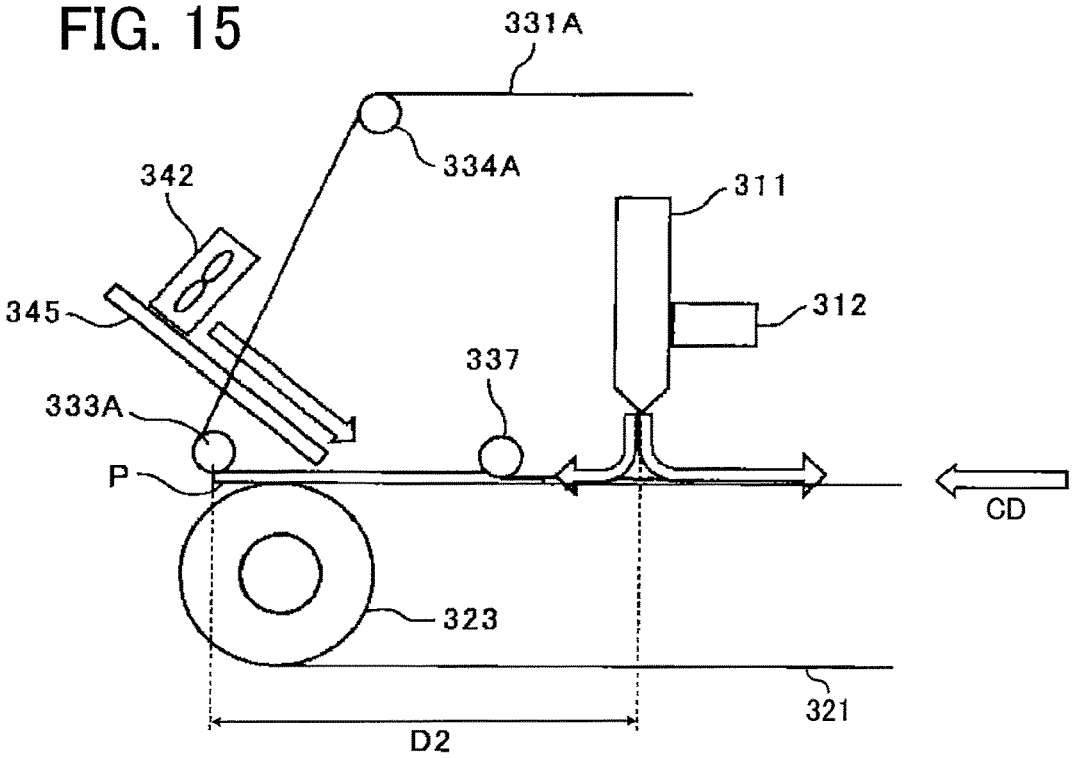
FIG. 15 is a front view of a portion of the drying unit on the downstream side in the sheet conveyance direction in Variation 3.

FIG. 15 is a front view illustrating a part of the drying unit 300 on the downstream side in the sheet conveyance direction CD in Variation 3. In Variation 3, the air flow guide 345 which rectifies the flow of the air until the air from the downstream blowing fan 342 reaches the vicinity of the sheet conveyance path (the surface of the conveyance belt 321) is attached to the downstream blowing fan 342. The air flow guide 345 is provided so that the rectifying surface extends along the blowing direction of the downstream blowing fan 342, and reduces the air from the downstream blowing fan 342 from being diffused outside from the blowing direction. As a result, efficient blowing is performed in a target location (for example, a sheet conveying section from the blowing region to the sandwiching end position) D2.

The air flow guide 345 according to Variation 3 isolates the blowing route from the sheet conveyance path, until the air from the downstream blowing fan 342 reaches the vicinity of the target location D2 on the sheet conveyance path. As a result, the air from the downstream blowing fan 342 is prevented from flowing toward the trailing end of the sheet after passing through the target location D2, and it is possible to prevent the trailing end of the sheet after passing through the sandwiching end position from flapping due to the influence of the air from the downstream blowing fan 342.

Further, when there is a risk that the trailing end of the sheet after passing through the sandwiching end position is flapped due to the influence of the air from the downstream blowing fan 342, as in the case of Variation 2, the suction system 326 may be used together or a pressing roller may be disposed.

Variation 4

Next, still another variation of the drying unit 300 in the present embodiment (hereinafter, this variation will be referred to as "Variation 4") will be described. In the above-described embodiment (including each of Variations 1 to 3), an example of the drying unit 300 that dries the sheet after the ink is discharged and the image is formed has been described. However, in Variation 4, a treatment in which a predetermined treatment liquid is imparted to the sheet P by application or the like in the pre-processing unit is performed, and before ink is discharged and the image is formed in the image forming unit 200, the sheet to which the treatment liquid is applied is dried in the drying unit.

The basic configuration of Variation 4 is the same as that of the inkjet recording apparatus 1 according to the above embodiment, except that a pre-processing unit and a drying unit are added between the sheet feeding unit 100 and the image forming unit 200. The basic configuration of the added drying unit is also the same as in the above-described embodiment. Therefore, the differences from the above-described embodiment will be mainly described below.

Figure 16:
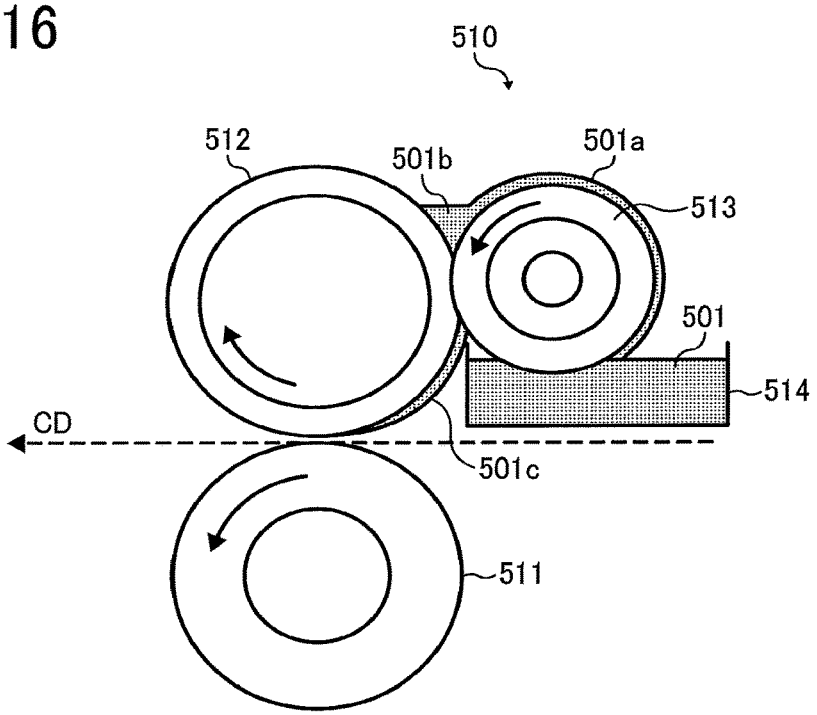
FIG. 16 is an illustration of a portion of an application device as a pre-processing unit in Variation 4.

FIG. 16 is an illustration of a main part of an application device as pre-processing unit used in Variation 4. The pre-processing unit of Variation 4 includes an application device 510 that applies a treatment liquid to the sheet P fed from the sheet feeding unit 100. As the treatment liquid, for example, there is a modifying material that modifies the surface of the sheet by being applied to the surface of the sheet. Specifically, there is a fixing agent (setting agent), in which, by preliminarily applying the ink to the sheet uniformly, the moisture of the ink is quickly permeated into the sheet, the color component is thickened, and the drying is accelerated to prevent bleeding (feathering, bleeding, or the like) or strike-through, and it is possible to enhance productivity (the number of images output per unit time).

Compositionally, as the treatment liquid, for example, a solution can be used in which cellulose (for example, hydroxypropyl cellulose) which promotes penetration of moisture and a base material, such as talc fine powder, are added to surfactant (for example, one of anionic, cationic or nonionic one or a mixture of two or more of them). The treatment liquid may also contain fine particles.

The application device 510 of Variation 4 has a conveyance roller 511 to convey the sheet, an application roller 512 to apply a treatment liquid 501 to the sheet to face the conveyance roller 511, and a squeeze roller 513 to supply the treatment liquid 501 to the application roller 512 to thin the liquid film (the film of the treatment liquid 501). The direction of rotation of each roller is the direction indicated by the arrow in the drawings. In these rollers, the application roller 512 is disposed in contact with the conveyance roller 511, and the squeeze roller 513 is disposed in contact with the application roller 512.

In Variation 4, when the treatment liquid 501 is applied to the sheet by the application device 510, by the rotation of the squeeze roller 513 in the direction indicated by the arrow in the drawings, the treatment liquid 501 in the liquid tray 514 scoops up on the surface of the squeeze roller 513, is transferred in the state of the liquid film layer 501*a* by the rotation, and is accumulated on a valley portion (contact portion: sandwiching portion) between the squeeze roller 513 and the application roller 512 (treatment liquid 501*b*). Here, the squeeze roller 513 and the application roller 512 are in contact with each other at a constant pressing force. When the treatment liquid 501*b* stored in the valley portion passes between the squeeze roller 513 and the application roller 512, the treatment liquid 501*b* is squeezed by pressure. The liquid film layer 501*c* of the treatment liquid 501 is formed and is conveyed to the conveyance roller 511 side by the rotation of the application roller 512. The liquid film layer 501*c* transferred by the application roller 512 is applied to the sheet.

The sheet to which the liquid film layer 501*c* of the treatment liquid 501 is applied in this manner is conveyed to a drying unit having the same configuration as the drying unit 300 of the above embodiment (including each of Variations 1 to 3), and the drying process is performed. The sheet after being subjected to the drying process by the drying unit is fed to the image forming unit 200, and an image is formed by discharging of ink in the image forming unit 200.

In the above-described embodiments (including each of Variations 1 through 4), a pair of sandwiching members as a sandwiching unit to sandwich the sheet between the pair of sandwiching members includes surface movable members, such as the conveyance belts 321 and 325, and a presser, such as end pressing belts 331A and 331B, and the sheet is conveyed with the movement of the surface of the surface movable member. However, embodiments of the present disclosure are not limited to such a configuration. It goes without saying that the pair of sandwiching members is not required to have the function of conveying the sheet as long as the sandwiching members have the function of sandwiching the sheet between the pair of sandwiching members. Therefore, apart from the pair of sandwiching members, a conveying member having a function of conveying the sheet may be provided, and the sheet sandwiched by the pair of sandwiching members may be conveyed by the conveying member.

The above-described embodiments are limited examples, and the present disclosure includes, for example, the following aspects having advantageous effects.

Aspect A

A conveying device, such as the drying unit 300, includes a blower, such as the blowing fan 311, to blow air to a sheet material, such as sheet P, and a conveyor, such as the belt conveyor 320, including a sandwiching unit (a plurality of sandwiching members), such as the conveyance belts 321 and the end pressing belts 331A and 331B, to sandwich the sheet material, to convey the sheet material so that the sheet material enters a blowing region of the blower. The conveying device further has an upstream blower, such as the upstream blowing fan 341, to blow air toward a downstream side in a conveyance direction of the sheet material, such as the sheet conveyance direction CD, from an upstream side of the blowing region in the conveyance direction of the sheet material to the blowing region. According to aspect A, by the blowing of the upstream blower, the air flow, such as the air flow F3, toward the downstream side in the conveyance direction of the sheet material can be generated from the upstream side in the conveyance direction of the sheet material toward the blowing region. As a result, the momentum of the air flow, such as the air flow F1, flowing from the blowing region to the sandwiching start position generated by the blowing of the blower in the blowing region is offset by the air flow, such as the air flow F3, caused by the air blown by the upstream blower. Alternatively, the air flow, such as the air flow F3, caused by the air blown by the upstream blower overcomes the air flow, such as the air flow F1, flowing from the blowing region to the sandwiching start position, thus allowing the generation of an air flow flowing from the upstream side to the downstream side in the conveyance direction of the sheet material at the sandwiching start position. As a result, the momentum of the air flow F1 toward the upstream side in the conveyance direction of the sheet material at the sandwiching start position decreases or is eliminated, thus reducing the curling up of the leading end of the sheet material by the air flow F1 before entering the sandwiching start position. Accordingly, the sheet material can appropriately enter between the pair of sandwiching members.

Aspect B

In the above-described aspect A, the upstream blower may blow the air so that the momentum of the air flow, such as the air flow F1, flowing from the sandwiching start position of the sheet material, at which the sheet material is started to be sandwiched between the pair of sandwiching members, toward the upstream side in the conveyance direction of the sheet material decreases or so that an air flow flowing from an upstream side to a downstream side of the sandwiching start position in the conveyance direction of the sheet material is generated. Such a configuration can reduce the curling of the leading end of the sheet material at the sandwiching start position by the air flow F1 flowing to the upstream side in the conveyance direction of the sheet material before the sheet material enters the sandwiching start position, thus causing the sheet material to properly enter the pair of sandwiching members.

Aspect C

In the above-described aspect A or B, the conveying device has a blowing chamber, such as the drying chamber 313. The blowing chamber includes a wall member, such as the wall member 313*d*, surrounding the blowing region and a sheet inlet, such as the sheet inlet 313*a*, to receive the sheet material from the upstream side in the conveyance direction of the sheet material. The upstream blower blows the air toward the downstream side in the conveyance direction of the sheet material, from the upstream side of the sheet inlet in the conveyance direction of the sheet material to the sheet inlet. When the blowing region is located inside the blowing chamber, the air flow generated by blowing is easily blown outward strongly from the sheet inlet, a strong air flow blown out of the sheet inlet hits the leading end of the sheet material before entering the sandwiching start position, and the leading end of the sheet material easily curls up. According to aspect C, the upstream blower blows air toward the downstream side in the conveyance direction of the sheet material, from the upstream side of the sheet inlet in the conveyance direction of the sheet material toward the sheet inlet. Such a configuration can reduce the momentum of the air flow blown out of the sheet inlet. Accordingly, such a configuration can reduce the curling of the leading end of the sheet material before entering the sandwiching start position by the air flow blown out of the sheet inlet, thus causing the sheet material to appropriately enter between the pair of sandwiching members.

Aspect D

A conveying device, such as the drying unit 300, includes a blower, such as the blowing fan 311, to blow air to a sheet material, such as the sheet P, and a conveyor, such as the belt conveyor 320, including a sandwiching unit (a pair of sandwiching members), such as the conveyance belt 321 and the end pressing belts 331A and 331B, to sandwich the sheet material, to convey the sheet material so that the sheet material sandwiched between a pair of sandwiching members enters a blowing region blown by the blower. The conveying device further includes a downstream blower, such as the downstream blowing fan 342, to blow air toward an upstream side in the conveyance direction of the sheet material, from a downstream side of the blowing region in the conveyance direction of the sheet material to the blowing region. Such a configuration can generate an air flow, such as the air flow F4, toward the upstream side in the conveyance direction of the sheet material by the blowing of the downstream blower, from the downstream side in the conveyance direction of the sheet material toward the blowing region. As a result, the momentum of the air flow F2 flowing from the blowing region to the sandwiching end position generated by the blowing of the blower in the blowing region is offset by the air flow F4 caused by the air blown by the downstream blower. Alternatively, the air flow F4 caused by the air blown by the downstream blower overcomes the air flow F2, and it is also possible to generate an air flow flowing from the downstream side to the upstream side in the conveyance direction of the sheet material at the sandwiching end position. As a result, since the momentum of the air flow F2 toward the downstream side in the conveyance direction of the sheet material at the sandwiching end position decreases or is eliminated, the trailing end of the sheet material after passing through the sandwiching end position is prevented from being curled up or flapped by the air flow F2. Therefore, it is possible to achieve the stable sheet material conveyance.

Aspect E

In the aspect D, the downstream blower may perform the blowing so that the momentum of the air flow F2 flowing from the sandwiching end position at which the sheet material is sandwiched between the pair of sandwiching members toward the downstream side in the conveyance direction of the sheet material decreases, or so that an air flow flowing from the downstream side to the upstream side in the conveyance direction of the sheet material at the sandwiching end position is generated. Such a configuration can reduce the curling or flapping of the trailing end of the sheet material after passing the sandwiching end position by the air flow F2 to the downstream side in the sheet conveyance direction at the sandwiching end position, thus allowing stable conveyance of the sheet material.

Aspect F

In the above-described aspect D or E, the conveying device has a blowing chamber, such as the drying chamber 313. The blowing chamber includes a wall member, such as the wall member 313*d*, surrounding the blowing region and a sheet outlet, such as the sheet outlet 313*b*, to eject the sheet material to the downstream side in the conveyance direction of the sheet material. The downstream blower performs blowing toward the upstream side in the conveyance direction of the sheet material, from the downstream side of the sheet outlet in the conveyance direction of the sheet material to the sheet outlet. When the blowing region is located inside the blowing chamber, the air flow generated by blowing is easily blown outward strongly from the sheet outlet, a strong air flow blown out of the sheet outlet hits the trailing end of the sheet material after passing through the sandwiching end position, and the trailing end of the sheet material easily curls up or flaps. According to aspect F, the downstream blower blows an air toward the upstream side in the conveyance direction of the sheet material, from the upstream side of the sheet outlet in the conveyance direction of the sheet material toward the sheet outlet. Such a configuration can reduce the momentum of the air flow blown out of the sheet outlet. Therefore, it is possible to reduce the trailing end of the sheet material after passing through the sandwiching end position from being curled up or flapped by the air flow blown out of the sheet outlet, and the stable sheet material conveyance can be achieved.

Aspect G

In the above-described aspect C or F, a heat generator being adjustable in amount of heat generation may be disposed in the blowing chamber. According to aspect G, since a blown surface of the sheet material can be heated at a suitable temperature, the heat generator can be suitably used for drying process or the like of the sheet material.

Aspect H

In any one of the above-described aspects A to G, the conveyor includes a surface movable member, such as the conveyance belts 321 and 325 constituting one of the pairs of sandwiching members, to bear at least a portion of the sheet material placed in the blowing region, from the back side of a blown surface of the sheet material, and convey the sheet material with the movement of a surface of the surface movable member. According to aspect H, the air from the blower hits the surface of the surface movable member, and then travels along the surface of the surface movable member. Thus, the air flow F1 toward the leading end of the sheet material before entering the sandwiching start position, and the air flow F2 toward the trailing end of the sheet material after passing through the sandwiching end position, and the like are obtained. According to aspect H, since the momentum of the air flows F1 and F2 decreases or is eliminated, it is possible to reduce failure caused by the air flows F1 and F2.

Aspect I

In any one of the above-described aspects A to H, at least one blower among the blower, the upstream blower and the downstream blower is configured to be adjustable in air volume. According to aspect I, the blowing can be performed at an appropriate air volume.

Aspect J

In any one of the above-described aspects A to I, at least one blower of the upstream blower and the downstream blower is provided with an air flow guide such as air flow guides 343 and 345. According to aspect J, it is possible to efficiently blow air to the target locations D1 and D2 to be blowing by the upstream blower and the downstream blower.

Aspect K

A printing apparatus, such as the inkjet recording apparatus 1, includes a liquid discharger, such as the liquid discharge heads 220C, 220M, 220Y and 220K, to discharge liquid, such as ink, onto a sheet material, such as the sheet P, and the conveying device according to any one of the above-described aspects A to J, such as the drying unit 300, to blow air to and convey the sheet material to which the liquid having been discharged by the liquid discharger adheres. According to aspect K, a printing apparatus having stable sheet conveyance properties can be achieved.

Aspect L

A printing apparatus, such as the inkjet recording apparatus 1, includes a liquid discharger, such as the liquid discharge heads 220C, 220M, 220Y and 220K, to discharge liquid, such as ink, to a sheet material, such as the sheet P, a pre-processing unit, such as the application device 510, disposed on the upstream side of the liquid discharger in the conveyance direction of the sheet material to apply a treatment liquid, such as the treatment liquid 501, to the sheet material before the liquid is discharged, and the conveying device, such as the drying unit 300, according to any one of the above-described aspects A to J disposed on the upstream side of the liquid discharger in the conveyance direction of the sheet material to blow air to and convey the sheet material to which the treatment liquid has been applied by the pre-processing unit. According to aspect L, a printing apparatus having stable sheet conveyance properties can be achieved.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A conveying device, comprising:

a blower configured to blow air to a part of a sheet material; and a conveyor, including two end pressing belts to sandwich the sheet material, configured to convey the sheet material to a blowing region of the blower; and an upstream blower configured to blow air to the part of the sheet material at a same time as the blower blowing the air to the part of the sheet material, the air from the upstream blower blowing toward a downstream side of the blowing region in a conveyance direction of the sheet material from an upstream side of the blowing region in the conveyance direction of the sheet material.

2. The conveying device according to claim 1, wherein the upstream blower is configured to blow the air to decrease momentum of an air flow flowing from a sandwiching start position of the sheet material toward the upstream side in the conveyance direction of the sheet material.

3. The conveying device according to claim 1, wherein the upstream blower blows the air to generate an air flow flowing from an upstream side to a downstream side of a sandwiching start position in the conveyance direction of the sheet material.

4. The conveying device according to claim 2, further comprising:

a blowing chamber including a wall member surrounding the blowing region; and a sheet inlet configured to receive the sheet material from the upstream side in the conveyance direction of the sheet material, wherein the upstream blower is disposed outside the blowing chamber and is further configured to blow the air toward the sheet inlet.

5. The conveying device according to claim 4, further comprising;

a heat generator disposed in the blowing chamber.

6. The conveying device according to claim 1, wherein the conveyor includes a surface movable member that is configured to hold the sheet material placed in the blowing region and convey the sheet material with movement of a surface of the movable member.

7. The conveying device according to claim 1, further comprising:

a controller configured to adjust an air volume of at least one blower of the blower and the upstream blower.

8. The conveying device according to claim 1, further comprising:

an air flow guide disposed at the upstream blower.

9. A printing apparatus, comprising:

a liquid discharger configured to discharge liquid to the sheet material; and the conveying device according to claim 1, wherein the sheet material processed by the conveying device includes the liquid discharged by the liquid discharger adhering to the sheet material.

10. A printing apparatus, comprising:

a liquid discharger configured to discharge liquid;

a pre-processing device disposed on an upstream side of the liquid discharger in the conveyance direction of the sheet material and configured to apply a treatment liquid to the sheet material before the liquid discharger discharges the liquid onto the sheet material; and the conveying device according to claim 1.

11. The conveying device according to claim 1, further comprising:

a downstream blower configured to blow air toward the upstream side of the blowing region in the conveyance direction of the sheet material, from the downstream side of the blowing region in the conveyance direction of the sheet material.

12. The conveying device according to claim 11, wherein the downstream blower blows the air to decrease momentum of an air flow flowing from a sandwiching end position toward a downstream side of the sandwiching end position in the conveyance direction of the sheet material.

13. the conveying device according to claim 11, wherein the downstream blower blows the air to generate an air flow flowing from the downstream side to an upstream side of a sandwiching end position in the conveyance direction of the sheet material.

14. The conveying device according to claim 12, further comprising:

a blowing chamber including a wall member surrounding the blowing region; and a sheet outlet configured to eject the sheet material to a downstream side of the blowing chamber in the conveyance direction of the sheet material, wherein the downstream blower is disposed outside the blowing chamber and configured to blow the air toward the sheet outlet.

15. A conveying device, comprising:

a blower configured to blow air to a sheet material;

a wall member surrounding the blower and including a sheet inlet configured to receive the sheet material;

a conveyance belt partially extending to an inside and outside of the wall member; and an upstream blower disposed outside the wall member and upstream from the sheet inlet of the wall member in a direction of conveyance of the sheet material, wherein the upstream blower is configured to blow air to the sheet inlet of the wall member.

16. A printing apparatus, comprising:

a liquid discharger configured to discharge liquid to the sheet material; and the conveying device according to claim 15, wherein the sheet material processed by the conveying device includes the liquid discharged by the liquid discharger adhering to the sheet material.

17. A printing apparatus, comprising:

a blower configured to blow air to a sheet material;

a conveyor including a conveyance belt to convey the sheet material and a suction system to suck the sheet material to attract the sheet material onto the conveyance belt;

a wall member opposed to the conveyance belt and surrounding the blower;

a sheet inlet between the wall member and the conveyance belt and configured to receive the sheet material; and an upstream blower disposed outside the wall member and upstream from the sheet inlet of the wall member in a direction of conveyance of the sheet material, wherein the upstream blower is configured to blow air to the sheet material to guide the sheet material to the sheet inlet.

18. The conveying device according to claim 17, wherein the conveyance belt extends to an upstream side of the wall member from the wall member in the opposite direction of conveyance of the sheet material and is opposed to the upstream blower.

19. The conveying device according to claim 17, wherein the upstream blower is configured to blow the air to the sheet material obliquely from an upstream side to a downstream side in the direction of conveyance of the sheet material.

20. A printing apparatus, comprising:

a liquid discharger configured to discharge liquid to the sheet material; and the conveying device according to claim 17, wherein the sheet material processed by the conveying device includes the liquid discharged by the liquid discharger adhering to the sheet material.

* * * * *